US010438729B2

(12) United States Patent
Wyatt et al.

(10) Patent No.: US 10,438,729 B2
(45) Date of Patent: Oct. 8, 2019

(54) RESISTOR WITH UPPER SURFACE HEAT DISSIPATION

(71) Applicant: Vishay Dale Electronics, LLC, Columbus, NE (US)

(72) Inventors: Todd L. Wyatt, Columbus, NE (US); Darin W. Glenn, Columbus, NE (US)

(73) Assignee: Vishay Dale Electronics, LLC, Columbus, NE (US)

( * ) Notice: Subject to any disclaimer, the term of this patent is extended or adjusted under 35 U.S.C. 154(b) by 0 days.

(21) Appl. No.: 16/181,006

(22) Filed: Nov. 5, 2018

(65) Prior Publication Data

US 2019/0148039 A1 May 16, 2019

Related U.S. Application Data

(60) Provisional application No. 62/584,505, filed on Nov. 10, 2017.

(51) Int. Cl.
*H01C 1/084* (2006.01)
*H01C 1/034* (2006.01)
(Continued)

(52) U.S. Cl.
CPC ..... *H01C 1/084* (2013.01); *H01C 1/01* (2013.01); *H01C 1/034* (2013.01); *H01C 1/148* (2013.01);
(Continued)

(58) Field of Classification Search
CPC ..... H01C 1/084; H01C 1/148; H01C 17/02; H01C 17/28
See application file for complete search history.

(56) References Cited

U.S. PATENT DOCUMENTS 2,662,957 A 12/1953 Eisler
3,488,767 A 1/1970 Collins
(Continued)

FOREIGN PATENT DOCUMENTS

AU 783451 10/2005
CN 2515773 Y 10/2002
(Continued)

OTHER PUBLICATIONS

ISABELLENHÜTTE ISA-PLAN®—SMD Präzisionswiderstände/SMD precision resistors, SMV Bauform/Size: 4723 Data Sheet, Issue SMV—Nov. 11, 2011, p. 1-4.
(Continued)

*Primary Examiner* — Kyung S Lee
(74) *Attorney, Agent, or Firm* — Volpe and Koenig, P.C.

(57) ABSTRACT

Resistors and a method of manufacturing resistors are described herein. A resistor includes a resistive element and a plurality of upper heat dissipation elements. The plurality of heat dissipation elements are electrically insulated from one another via a dielectric material and thermally coupled to the resistive element via an adhesive material disposed between each of the plurality of heat dissipation elements and a surface of the resistive element. Electrode layers are provided on a bottom surface of the resistive element. Solderable layers form side surfaces of the resistor and assist in thermally coupling the heat dissipation elements, the resistor and the electrode layers.

20 Claims, 24 Drawing Sheets

(51) Int. Cl.

| | |
|---|---|
| ***H01C 17/02*** | (2006.01) |
| ***H01C 1/01*** | (2006.01) |
| ***H01C 17/28*** | (2006.01) |
| ***H01C 1/148*** | (2006.01) |
| *C22C 9/00* | (2006.01) |

(52) U.S. Cl.

CPC ..... *H01C 17/02* (2013.01); *H01C 17/28* (2013.01); *C22C 9/00* (2013.01)

(56) References Cited

U.S. PATENT DOCUMENTS 3,824,521 A 7/1974 Horii et al.
RE28,597 E 10/1975 Horii et al.
3,955,068 A 5/1976 Shaheen
4,176,445 A 12/1979 Solow
4,297,670 A 10/1981 Solow
4,368,252 A 1/1983 Kakuhashi et al.
4,434,416 A 2/1984 Schonberger
4,517,546 A 5/1985 Kakuhashi et al.
4,529,960 A 7/1985 Uchida et al.
4,540,463 A 9/1985 Kakuhashi et al.
4,677,413 A 6/1987 Zandman et al.
4,684,916 A 8/1987 Ozawa
4,780,702 A 10/1988 Snel et al.
5,111,179 A 5/1992 Flassayer et al.
5,252,943 A 10/1993 Kitabayashi et al.
5,254,493 A 10/1993 Kumar
5,287,083 A 2/1994 Person et al.
5,391,503 A 2/1995 Miwa et al.
5,428,885 A 7/1995 Takaya et al.
5,474,948 A 12/1995 Yamazaki
5,543,775 A 8/1996 Huck
5,563,572 A 10/1996 Hetzler
5,604,477 A * 2/1997 Rainer ..... H01C 17/006 29/621
5,635,893 A 6/1997 Spraggins et al.
5,680,092 A 10/1997 Yamada et al.
5,683,566 A 11/1997 Hetzler
5,683,928 A 11/1997 Wojnarowski et al.
5,703,561 A * 12/1997 Yamamoto ..... H01C 1/16 338/50
5,753,391 A 5/1998 Stone et al.
5,815,065 A 9/1998 Hanamura
5,876,903 A 3/1999 Ng et al.
5,899,724 A 5/1999 Dobuzinsky et al.
5,916,733 A 6/1999 Koyama
5,976,392 A 11/1999 Chen
5,990,780 A 11/1999 Caddock
5,997,998 A 12/1999 Sawamura
6,081,181 A 6/2000 Kawase et al.
6,150,920 A 11/2000 Hashimoto et al.
6,189,767 B1 2/2001 Haspeslagh
6,256,850 B1 7/2001 Lauffer et al.
6,267,471 B1 7/2001 Ramaswami et al.
6,280,907 B1 8/2001 Chung et al.
6,356,455 B1 3/2002 Carpenter
6,365,956 B1 4/2002 Nonaka
6,423,951 B1 7/2002 Elsasser
6,489,035 B1 12/2002 Wang et al.
6,492,896 B2 12/2002 Yoneda
6,528,860 B2 3/2003 Okamoto et al.
6,529,115 B2 3/2003 Szwarc et al.
6,666,980 B1 12/2003 Wikstrom
6,703,683 B2 3/2004 Tanimura
6,727,798 B2 4/2004 Akhtman et al.
6,751,848 B2 6/2004 Nagakura et al.
6,771,160 B2 8/2004 Wang et al.
6,781,506 B2 8/2004 Schemenaur et al.
6,794,985 B2 9/2004 Nakamura et al.
6,798,189 B2 9/2004 Hirasawa
6,801,118 B1 10/2004 Ikemoto et al.
6,925,704 B1 8/2005 Schneekloth et al.
6,935,016 B2 8/2005 Hashimoto et al.
6,963,192 B2 8/2005 Urano
6,952,021 B2 10/2005 Tanaka et al.
7,042,330 B2 5/2006 Nakamura et al.
7,053,749 B2 5/2006 Ishida et al.
7,057,490 B2 6/2006 Hashimoto et al.
7,059,041 B2 6/2006 Behammer
7,190,252 B2 3/2007 Smith et al.
7,193,499 B2 3/2007 Tsukada
7,238,296 B2 7/2007 Moriya
7,278,201 B2 10/2007 Szwarc et al.
7,292,022 B2 11/2007 Hirasawa
7,342,480 B2 3/2008 Tsukada
D566,043 S 4/2008 Nakamura et al.
7,358,592 B2 4/2008 Ueno
7,372,127 B2 5/2008 Aisenbrey
7,378,937 B2 5/2008 Tsukada
7,380,333 B2 6/2008 Tsukada et al.
7,382,627 B2 6/2008 Borland et al.
7,420,454 B2 9/2008 Takagi et al.
7,425,753 B2 9/2008 Kato et al.
7,571,536 B2 8/2009 McGregor
7,601,920 B2 10/2009 Fujimoto
7,602,026 B2 10/2009 Horii et al.
7,667,568 B2 2/2010 Tanimura et al.
7,691,276 B2 4/2010 Sebev
7,691,487 B2 4/2010 Nagatani
7,718,502 B2 5/2010 Yamashita et al.
7,737,818 B2 6/2010 Djordjevic et al.
7,782,173 B2 8/2010 Urano et al.
7,782,174 B2 8/2010 Urano
7,862,900 B2 1/2011 Andresakis et al.
7,882,621 B2 2/2011 Chen et al.
7,943,437 B2 5/2011 Voldman
7,949,983 B2 5/2011 Eshun et al.
7,982,579 B2 7/2011 Zama et al.
8,013,713 B2 9/2011 Hetzler
8,018,318 B2 9/2011 Wang et al.
8,042,261 B2 10/2011 Su
8,044,765 B2 10/2011 Tsukada
8,051,558 B2 11/2011 Lin et al.
8,085,551 B2 12/2011 Karasawa et al.
8,111,130 B2 2/2012 Tsukada
8,149,082 B2 4/2012 Hirasawa et al.
8,203,422 B2 6/2012 Naito et al.
8,212,649 B2 7/2012 Fujiwara et al.
8,212,767 B2 7/2012 Sawada et al.
8,242,878 B2 8/2012 Smith et al.
8,278,217 B2 10/2012 Imanaka et al.
8,310,334 B2 11/2012 Chen et al.
8,319,499 B2 11/2012 Gronwald et al.
8,324,816 B2 12/2012 Chashi et al.
8,325,006 B2 12/2012 Yoneda
8,325,007 B2 12/2012 Smith et al.
8,400,257 B2 3/2013 Lim et al.
8,405,318 B2 3/2013 Hatakenaka et al.
8,432,248 B2 4/2013 Sakai et al.
8,436,426 B2 5/2013 LeNeel et al.
8,456,273 B2 6/2013 Chen
8,471,674 B2 6/2013 Yoshioka
8,576,043 B2 11/2013 Liu et al.
8,581,225 B2 11/2013 Himeno et al.
8,598,975 B2 12/2013 Miura
8,686,828 B2 4/2014 Smith et al.
8,823,483 B2 9/2014 Smith et al.
8,895,869 B2 11/2014 Mizokami
9,177,701 B2 11/2015 Harada et al.
9,293,242 B2 3/2016 Yoshioka et al.
9,378,873 B2 6/2016 Yoshioka et al.
9,396,849 B1 7/2016 Wyatt et al.
9,437,352 B2 9/2016 Kameko et al.
9,633,768 B2 4/2017 Yoneda
9,711,265 B2 7/2017 Harada et al.
9,728,306 B2 * 8/2017 Lu ..... H01C 17/02
9,859,041 B2 1/2018 Yoneda
9,870,849 B2 1/2018 Yoneda
9,881,719 B2 1/2018 Harada et al.
9,911,524 B2 3/2018 Tanaka et al.
10,102,948 B2 10/2018 Harada et al.
10,141,088 B2 11/2018 Mikamoto et al.
2002/0031860 A1 3/2002 Tanimura

(56) References Cited

U.S. PATENT DOCUMENTS

| | | | | |
|---|---|---|---|---|
| 2002/0109577 | A1 | 8/2002 | Loose et al. | |
| 2002/0130757 | A1 | 9/2002 | Huang et al. | |
| 2002/0130761 | A1 | 9/2002 | Tsukada | |
| 2002/0140038 | A1 | 10/2002 | Okamoto et al. | |
| 2002/0146556 | A1 | 10/2002 | Pankow et al. | |
| 2003/0016118 | A1 | 1/2003 | Schemenaur et al. | |
| 2003/0076643 | A1 | 4/2003 | Chu et al. | |
| 2003/0201870 | A1 | 10/2003 | Ikemoto et al. | |
| 2003/0227731 | A1 | 12/2003 | Huang et al. | |
| 2004/0113750 | A1 | 6/2004 | Matsukawa et al. | |
| 2004/0168304 | A1 | 9/2004 | Smejkal et al. | |
| 2004/0196139 | A1 | 10/2004 | Nakamura et al. | |
| 2004/0252009 | A1 | 12/2004 | Tsukada | |
| 2004/0263150 | A1* | 12/2004 | Hetzler | G01R 1/203 324/126 |
| 2005/0104711 | A1 | 5/2005 | Smejkal et al. | |
| 2005/0164520 | A1 | 7/2005 | Muranaka et al. | |
| 2005/0258930 | A1 | 11/2005 | Ishida et al. | |
| 2006/0127815 | A1 | 6/2006 | Sato et al. | |
| 2006/0255404 | A1 | 11/2006 | Kao | |
| 2006/0286716 | A1 | 12/2006 | Takayama | |
| 2006/0286742 | A1 | 12/2006 | Chen | |
| 2007/0052091 | A1 | 3/2007 | Weekamp et al. | |
| 2007/0108479 | A1 | 5/2007 | Okumura | |
| 2007/0132545 | A1 | 6/2007 | Tsukada | |
| 2007/0262845 | A1 | 11/2007 | Takagi et al. | |
| 2008/0094168 | A1 | 4/2008 | Hynes et al. | |
| 2008/0216306 | A1 | 9/2008 | Fujimoto | |
| 2008/0224818 | A1 | 9/2008 | Tanimura et al. | |
| 2008/0233704 | A1 | 9/2008 | Fechner et al. | |
| 2008/0272879 | A1 | 11/2008 | Tsukada | |
| 2009/0002121 | A1* | 1/2009 | Tsai | H01C 1/142 338/195 |
| 2009/0108986 | A1 | 4/2009 | Urano et al. | |
| 2009/0115569 | A1 | 5/2009 | Urano | |
| 2009/0153287 | A1 | 6/2009 | Tsukada | |
| 2009/0322467 | A1 | 12/2009 | Hetzler | |
| 2009/0322468 | A1 | 12/2009 | Hanaoka et al. | |
| 2010/0039211 | A1 | 2/2010 | Wang et al. | |
| 2010/0236065 | A1 | 9/2010 | Miyamoto | |
| 2010/0328021 | A1* | 12/2010 | Hirasawa | H01C 1/028 338/226 |
| 2011/0156860 | A1 | 6/2011 | Smith et al. | |
| 2011/0198705 | A1 | 8/2011 | Chen et al. | |
| 2012/0111613 | A1 | 5/2012 | Oguro et al. | |
| 2012/0223807 | A1 | 9/2012 | Sakai et al. | |
| 2012/0229247 | A1 | 9/2012 | Yoshioka | |
| 2013/0025915 | A1 | 1/2013 | Lin et al. | |
| 2013/0176655 | A1 | 7/2013 | Tseng et al. | |
| 2013/0341301 | A1 | 12/2013 | Chen | |
| 2013/0342308 | A1 | 12/2013 | Chen | |
| 2014/0049358 | A1* | 2/2014 | Kim | H01C 7/00 338/309 |
| 2014/0054746 | A1 | 2/2014 | Ohtake | |
| 2014/0085043 | A1 | 3/2014 | Suzuki et al. | |
| 2014/0097933 | A1 | 4/2014 | Yoshioka et al. | |
| 2014/0125429 | A1 | 5/2014 | Yoshioka et al. | |
| 2014/0210587 | A1 | 7/2014 | Smith et al. | |
| 2014/0370754 | A1 | 12/2014 | Kameko et al. | |
| 2015/0042444 | A1 | 2/2015 | Smith et al. | |
| 2015/0048923 | A1* | 2/2015 | Kameko | H01C 1/142 338/325 |
| 2015/0212115 | A1 | 6/2015 | Nakamura et al. | |
| 2015/0226768 | A1 | 8/2015 | Nakamura et al. | |
| 2015/0323567 | A1 | 11/2015 | Kitahara et al. | |
| 2016/0163433 | A1 | 6/2016 | Takeue et al. | |
| 2016/0225497 | A1 | 8/2016 | Amemiya et al. | |
| 2016/0343479 | A1 | 11/2016 | Itou | |
| 2017/0125141 | A1* | 5/2017 | Smith | H01C 1/032 |

FOREIGN PATENT DOCUMENTS

| | | | |
|---|---|---|---|
| CN | 201233778 | Y | 5/2009 |
| CN | 201345266 | Y | 11/2009 |
| CN | 101855680 | A | 10/2010 |
| CN | 102543330 | A | 7/2012 |
| CN | 102768888 | A | 11/2012 |
| CN | 102881387 | A | 1/2013 |
| CN | 103093908 | A | 5/2013 |
| CN | 104160459 | A | 11/2014 |
| DE | 3027122 | A1 | 2/1982 |
| EP | 0 621 631 | A1 | 10/1994 |
| EP | 0 829 886 | A2 | 3/1998 |
| EP | 0 841 668 | A1 | 5/1998 |
| EP | 0855722 | B1 | 10/2002 |
| EP | 1 762 851 | A2 | 3/2007 |
| GB | 813823 | A | 5/1959 |
| GB | 1264817 | A | 2/1972 |
| JP | H-02-110903 | A | 4/1990 |
| JP | H02-305402 | A | 12/1990 |
| JP | H05-152101 | A | 6/1993 |
| JP | H05-291002 | A | 11/1993 |
| JP | H06-77019 | A | 3/1994 |
| JP | 8-102409 | A | 4/1996 |
| JP | H10_256477 | A | 9/1998 |
| JP | 2000-232008 | A | 8/2000 |
| JP | 2001-093701 | A | 4/2001 |
| JP | 2001-116771 | A | 4/2001 |
| JP | 2002-184601 | A | 6/2002 |
| JP | 2002-208501 | A | 7/2002 |
| JP | 2002-313602 | A | 10/2002 |
| JP | 2003-017301 | A | 1/2003 |
| JP | 2003-045703 | A | 2/2003 |
| JP | 2003-124004 | A | 4/2003 |
| JP | 2003-197403 | A | 7/2003 |
| JP | 2003-264101 | A | 9/2003 |
| JP | 2004-087966 | A | 3/2004 |
| JP | 2004-128000 | A | 4/2004 |
| JP | 2005-072268 | A | 3/2005 |
| JP | 2005-197394 | A | 7/2005 |
| JP | 2005-197660 | A | 7/2005 |
| JP | 2005-268302 | A | 9/2005 |
| JP | 2006-112868 | A | 4/2006 |
| JP | 2006-237294 | A | 9/2006 |
| JP | 2006-351776 | A | 12/2006 |
| JP | 2007-189000 | A | 7/2007 |
| JP | 2007-329419 | A | 12/2007 |
| JP | 2007-329421 | A | 12/2007 |
| JP | 2008-016590 | A | 1/2008 |
| JP | 2008-053591 | A | 3/2008 |
| JP | 2008-270599 | A | 11/2008 |
| JP | 2009-194316 | A | 8/2009 |
| JP | 2009-218317 | A | 9/2009 |
| JP | 2009252828 | A | 10/2009 |
| JP | 2009-289770 | A | 12/2009 |
| JP | 2009-295877 | A | 12/2009 |
| JP | 2010-165780 | A | 7/2010 |
| JP | 4503122 | B2 | 7/2010 |
| JP | 4542608 | B2 | 9/2010 |
| JP | 4563628 | B2 | 10/2010 |
| JP | 2011-124502 | A | 6/2011 |
| JP | 2012-064762 | A | 3/2012 |
| JP | 2012-175064 | A | 9/2012 |
| JP | 2002-299102 | A | 10/2012 |
| JP | 5256544 | B2 | 8/2013 |
| JP | 5263734 | B2 | 8/2013 |
| JP | 2013-254988 | A | 12/2013 |
| JP | 2014-135427 | A | 7/2014 |
| JP | 2015-061034 | A | 3/2015 |
| JP | 2015-070166 | A | 4/2015 |
| JP | 2015-079872 | A | 4/2015 |
| JP | 2015-119125 | A | 6/2015 |
| JP | 5812248 | B2 | 11/2015 |
| JP | 2016-086129 | A | 5/2016 |
| KR | 10-2004-0043688 | A | 5/2004 |
| KR | 10-2004-0046167 | A | 6/2004 |
| KR | 10-2011-0127282 | A | 11/2011 |
| RU | 2 497 217 | C1 | 10/2013 |
| TW | 201037736 | A | 10/2010 |
| TW | 201407646 | A | 2/2014 |
| WO | 99/40591 | A1 | 8/1999 |
| WO | 2005/081271 | A1 | 9/2005 |
| WO | 2009/145133 | A1 | 12/2009 |

(56) References Cited

FOREIGN PATENT DOCUMENTS

| | | | |
|---|---|---|---|
| WO | 2015/046050 | A1 | 4/2015 |
| WO | 2016/031440 | A1 | 3/2016 |
| WO | 2016/047259 | A1 | 3/2016 |
| WO | 2016/063928 | A1 | 4/2016 |
| WO | 2016/067726 | A1 | 5/2016 |
| WO | 2018/060231 | A1 | 4/2018 |

OTHER PUBLICATIONS

ISABELLENHÜTTE ISA-PLAN®—SMD Präzisionswiderstände/SMD precision resistors, SMT Bauform/Size: 2817 Data Sheet, Issue SMT—Feb. 3, 2012, pp. 1-4.

ISABELLENHÜTTE ISA-PLAN®—SMD Präzisionswiderstände/SMD precision resistors, SMR Bauform/Size: 4723 Data Sheet, Issue SMR—Feb. 7, 2012, pp. 1-4.

ISABELLENHÜTTE ISA-PLAN®—SMD Präzisionswiderstände/SMD precision resistors, SMS Bauform/Size: 2512 Data Sheet, Issue SMS—Feb. 8, 2012, pp. 1-4.

ISABELLENHÜTTE ISA-PLAN®//Precision Resistors, SMK//Size 1206 Data Sheet, Issue 13—Nov. 2013, pp. 1-4.

ISABELLENHÜTTE ISA-PLAN®—SMD Präzisionswiderstände/SMD precision resistors,VLK Bauform/Size: 0612 Data Sheet, Issue VLK—Apr. 18, 2013, pp. 1-4.

ISABELLENHÜTTE ISA-PLAN®—SMD Präzisionswiderstände/SMD precision resistors, VLP Bauform/Size: 1020 Data Sheet, Issue VLP—Apr. 18, 2013, pp. 1-4.

ISABELLENHÜTTE ISA-PLAN®—SMD Präzisionswiderstände/SMD precision resistors, SMP Bauform/Size: 2010 Data Sheet, Issue SMP—Apr. 19, 2013, pp. 1-4.

ISOTEK-ISABELLENHÜTTE ISA-PLAN®//Precision Resistors,VMI//Size 0805 Data Sheet, Issue 18—Jun. 2014, pp. 1-4.

ISOTEK-ISABELLENHÜTTE ISA-PLAN®//Precision Resistors, VMK//Size 1206 Data Sheet, Issue 14—Jul. 2014, pp. 1-4.

ISOTEK-ISABELLENHÜTTE ISA-PLAN®/Precision Resistors, VMP//Size 2010 Data Sheet, Issue 14—Jul. 2014, pp. 1-4.

ISOTEK-ISABELLENHÜTTE ISA-PLAN®/Precision Resistors, VMS//Size 2512 Data Sheet, Issue 14—Jul. 2014, pp. 1-4.

KOA Speer Electronics, Inc., "metal plate chip type low resistance resistors," TLRH, pp. 80 and 81 (Mar. 7, 2016).

* cited by examiner

RESISTOR WITH UPPER SURFACE HEAT DISSIPATION

FIELD OF INVENTION

This application relates to the field of electronic components and, more specifically, resistors and the manufacture of resistors.

BACKGROUND

Resistors are passive components used in circuits to provide electrical resistance by converting electrical energy into heat, which is dissipated. Resistors may be used in electrical circuits for many purposes, including limiting current, dividing voltage, sensing current levels, adjusting signal levels and biasing active elements. High power resistors may be required in applications such as motor vehicle controls, and such resistors may be required to dissipate many watts of electrical power. Where those resistors are also required to have relatively high resistance values, such resistors should be made to support resistive elements that are very thin and also able to maintain their resistance values under a full power load over a long period of time.

SUMMARY

Resistors and methods of manufacturing resistors are described herein.

According to an embodiment, a resistor includes a resistive element and a plurality of separated conductive elements, forming heat dissipation elements. The plurality of conductive elements may be electrically insulated from one another via a dielectric material and thermally coupled to the resistive element via an adhesive material disposed between each of the plurality of conductive elements and a surface of the resistive element. The plurality of conductive elements may also be thermally coupled to the resistive element via solderable terminals.

According to another embodiment, a resistor is provided comprising a resistive element having an upper surface, a bottom surface, a first side surface, and an opposite second side surface. A first conductive element and a second conductive element are joined to the upper surface of the resistive element by an adhesive. The first and second conductive elements function as heat dissipation elements. A gap is provided between the first conductive element and the second conductive element. The positioning of the first conductive element and the second conductive element leave exposed portions of the adhesive on the upper surface of resistive element. A first conductive layer is positioned along a bottom portion of the resistive element. A second conductive layer is positioned along a bottom portion of the resistive element. A dielectric material covers upper surfaces of the first conductive element and the second conductive element and fills the gap between the first conductive element and the second conductive element. A dielectric material is deposited on an outer surface of the resistor, and may be deposited on both the top and bottom of the resistor.

A method of manufacturing a resistor is also provided. The method comprises the steps of: laminating a conductor to a resistive element using an adhesive; plating electrode layers to bottom portions of the resistive element; masking and patterning the conductor to divide the conductor into heat dissipation elements; depositing a dielectric material on a top surface and bottom surface of the resistor; and plating the sides of the resistor with solderable layers. In an embodiment, the resistive element may be patterned, for example using chemical etching, and thinned, for example using a laser, to achieve a target resistance value.

According to another embodiment, a resistor is provided comprising a resistive element coupled to first and second heat dissipation elements via an adhesive, wherein the first and second heat dissipation elements are electrically insulated from one another by a dielectric material. Electrodes are provided on a bottom surface of the resistive element. First and second solderable components of the resistor may be formed on at least the first and second heat dissipation elements and the resistive element. The first and second heat dissipation elements receive the majority of heat generated by the resistor, while receiving and conducting very little current. The electrodes may conduct the vast majority of the current of the device.

BRIEF DESCRIPTION OF THE DRAWINGS

A more detailed understanding may be had from the following description, given by way of example in conjunction with the accompanying drawings wherein.

DETAILED DESCRIPTION

Figure 1A:
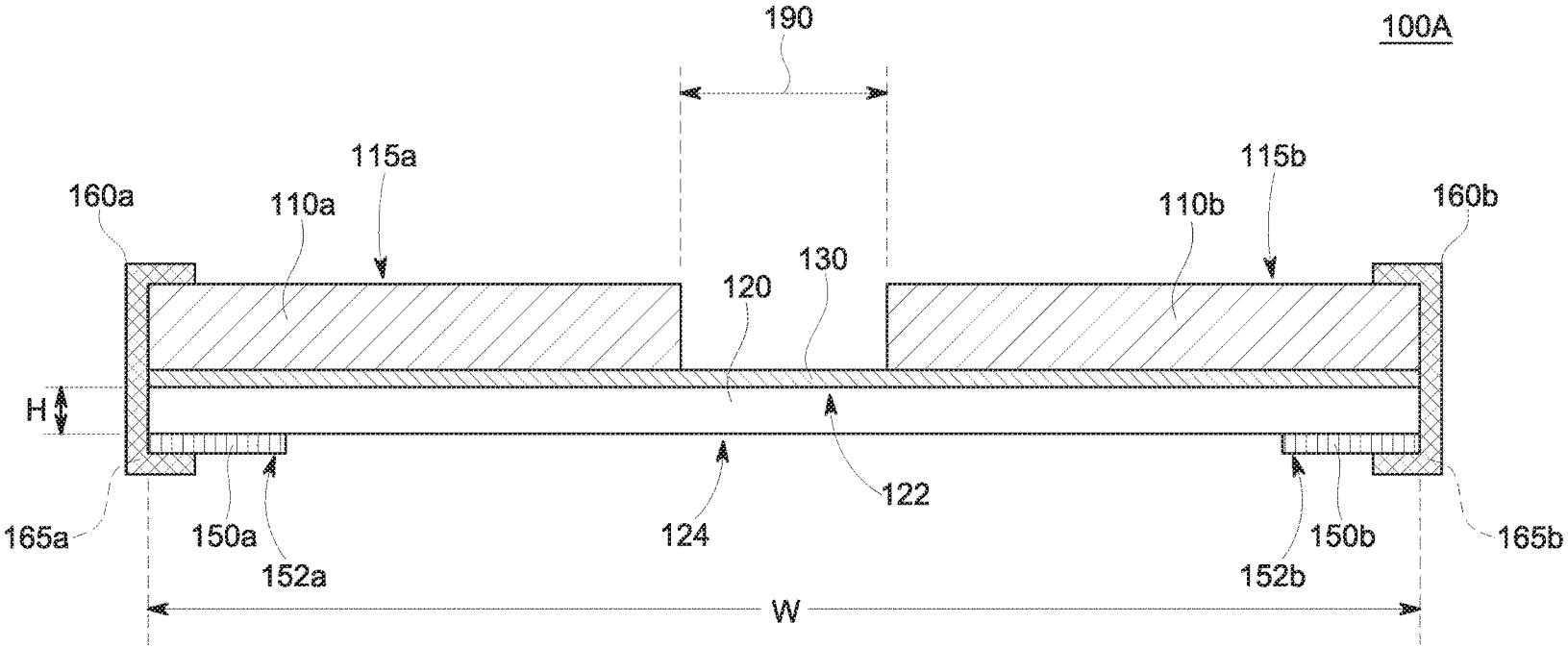
FIG. 1A shows a cross-sectional view of an example resistor.

Certain terminology is used in the following description for convenience only and is not limiting. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B or C as well as any combination thereof.

FIG. 1A is a diagram of a cross-section of an illustrative resistor 100. The resistor 100 illustrated in FIG. 1 includes a resistive element 120 positioned across the width of the resistor 100, and located between a first solderable terminals 160*a* and a second solderable terminals 160*b*, described in greater detail below. In the orientation shown in FIG. 1A for illustrative purposes, the resistive element has a top surface 122 and a bottom surface 124. The resistive element 120 is preferably a foil resistor. The resistive element may be formed from, by way of non-limiting example, copper, alloys of copper, nickel, aluminum, or manganese, or combinations thereof. Additionally, the resistive element may be formed from alloys of copper-nickel-manganese (CuNiMn), copper manganese tin (CuMnSn), copper nickel (CuNi), nickel-chromium-aluminum (NiCrAl), or nickel-chromium (NiCr), or other alloys known to those of skill in the art acceptable for use as a foil resistor. The resistive element 120 has a width "W" as designated in FIG. 1A. In addition, the resistive element 120 has a height or thickness of "H" as designated in FIG. 1A. The resistive element 120 has outer side surfaces or faces, facing in opposite directions, that may be generally planar or essentially flat.

As shown in FIG. 1A, a first heat dissipation element 110*a* and a second heat dissipation element 110*b* are positioned adjacent opposite side ends of the resistive element 120, with a gap 190 preferably provided between the first heat dissipation element 110*a* and a second heat dissipation element 110*b*. The heat dissipation elements 110*a* and 110*b* are formed from a thermally conductive material, and may preferably comprise copper, such as, for example, C110 or C102 copper. However, other metals with heat transfer properties, such as, for example, aluminum, may be used for the heat dissipation elements, and those of skill in the art will appreciate other acceptable metals for use as the heat dissipation elements 110*a* and 110*b*. The first heat dissipation element 110*a* and a second heat dissipation element 110*b* may have at least a portion that extends all the way to the outer side edges (or outer side surfaces) of the resistive element 120.

The heat dissipation elements 110*a* and 110*b* may be laminated, bonded, joined, or attached to the resistive element 120 via an adhesive material 130, which may comprise, by way of non-limiting example, materials such as DUPONT™, PYRALUX™, BOND PLY™, or other acrylic, epoxy, polyimide, or alumina filled resin adhesives in sheet or liquid form. Additionally, the adhesive material 130 may be composed of a material with electrically insulating and thermally conductive qualities. The adhesive material 130 may extend along the width "W" of the top surface 122 of the resistive element 120.

The heat dissipation elements 110*a* and 110*b* are positioned so that, when the resistor is attached to a circuit board, such as a printed circuit board (PCB), the heat dissipation elements 110*a* and 110*b* are positioned at the top of the resistor and distanced from the board. This can be seen in FIG. 1C.

As shown in FIG. 1A, a first 150*a* and second 150*b* electrode layers, which may also be referred to as conductive layers, are disposed along at least portions of the bottom surface 124 of the resistive element 120 at opposite side ends. The electrode layers 150*a* and 150*b* have opposite outer edges that preferably align with the opposite outer side edges (or outer side surfaces) of resistive element 120. Preferably, the first 150*a* and second 150*b* electrode layers are plated to the bottom surface 124 of the resistive element 120. In a preferred embodiment, copper may be used for the electrode layers. However, any platable and highly conductive metals may be used, as will be appreciated by those of skill in the art.

The outer side edges (or outer side surfaces) of the resistive element 120 and heat dissipation elements 110*a* and 110*b*, form solderable surfaces configured to receive solderable terminal 160*a* and 160*b* that may also be known as terminal platings. The outer side edges (or outer side surfaces) of the resistive element 120 and heat dissipation elements 110*a* and 110*b* also may preferably form planar, flat or smooth outer side surfaces, whereby the outer side edges of the resistive element 120 and heat dissipation elements 110*a* and 110*b* respectively align. As used herein, "flat" means "generally flat" and "smooth" means, i.e., within normal manufacturing tolerances. It is appreciated that the outer side surfaces may be somewhat or slightly rounded, bowed, curved or wavy based on the process used to form the resistor, while still being considered to be "flat."

The solderable terminals 160*a* and 160*b* may be separately attached at the lateral ends 165*a* and 165*b* of the resistor 100 to allow the resistor 100 to be soldered to a circuit board, which is described in more detail below with respect to FIG. 1B. As shown in FIG. 1A, the solderable terminals 160*a* and 160*b* preferably include portions that extend at least partially along bottom surfaces 152*a* and 152*b* of the electrode layers 150*a* and 150*b*. As shown in FIG. 1A, the solderable terminals 160*a* and 160*b* preferably include portions that extend partially along upper surfaces 115*a* and 115*b* of the heat dissipation elements 110*a* and 110*b*. Further, the use of a conductive layer, such as 150*a* and 150*b*, on the side of the resistive element that will be closest to a printed circuit board (PCB) may aid in creating a strong solder joint and centering the resistor on the PCB pads during solder reflow, as shown in FIG. 1B and described herein.

Figure 1B:
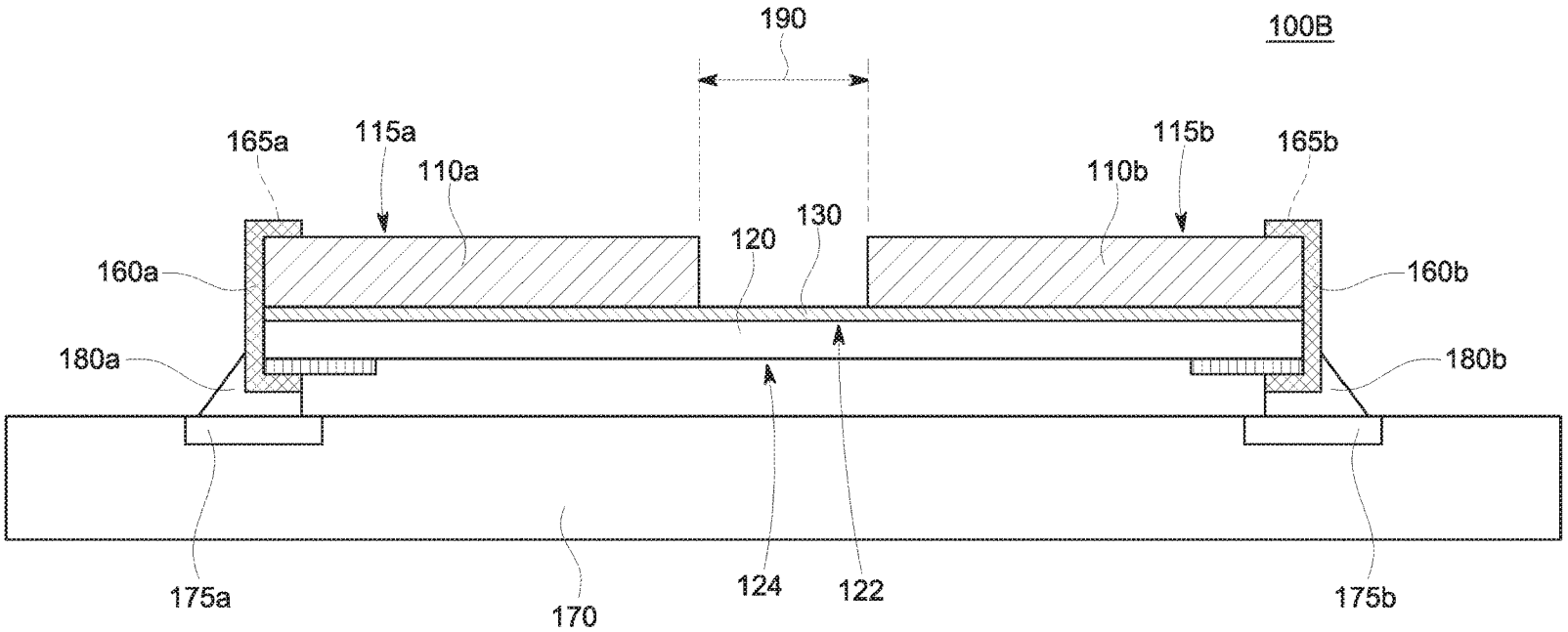
FIG. 1B shows a cross-sectional view of an example resistor on a circuit board.

FIG. 1B is a diagram of an illustrative resistor 100 mounted on a circuit board 170. In the example illustrated in FIG. 1B, the resistor 100 is mounted to the printed circuit board 170, also known as a PCB, using solder connections 180*a* and 180*b* between the solderable terminals 160*a* and 160*b* and corresponding solder pads 175*a* and 175*b* on the circuit board 170.

The heat dissipation elements 110*a* and 110*b* are coupled to the resistive element 120 via the adhesive 130. It is appreciated that the heat dissipation elements 110*a* and 110*b* may be thermally and/or mechanically and/or electrically coupled/connected or otherwise bonded, joined or attached to the resistive element 120. Of particular note, the solderable terminals 160*a* and 160*b* make the thermal and electrical connection between the resistive element 120 and the heat dissipation elements 110*a* and 110*b*. The thermal, electrical, and/or mechanical coupling/connection between the resistive element 120 and the lateral end of each of the heat dissipation elements 110*a* and 110*b* may enable the heat dissipation elements 110*a* and 110*b* to be used both as structural aspects for the resistor 100 and also as heat spreaders. Use of the heat dissipation elements 110*a* and 110*b* as a structural aspect for the resistor 100, may enable the resistive element 120 to be made thinner as compared to a self-supporting resistive elements, enabling the resistor 100 to be made to have a resistance of about 1 mΩ to 20Ω using foil thicknesses between about 0.015 inches and about 0.001 inches. In addition to providing support for the resistive element 120, efficient use of the heat dissipation elements 110*a* and 110*b* as heat spreaders may enable the resistor 100 to dissipate heat more effectively resulting in a higher power rating as compared to resistors that do not use heat spreaders. For example, a typical power rating for a 2512 size metal strip resistor is 1 W. Using the embodiments described herein, the power rating for a 2512 size metal strip resistor may be 3 W.

Figure 1C:
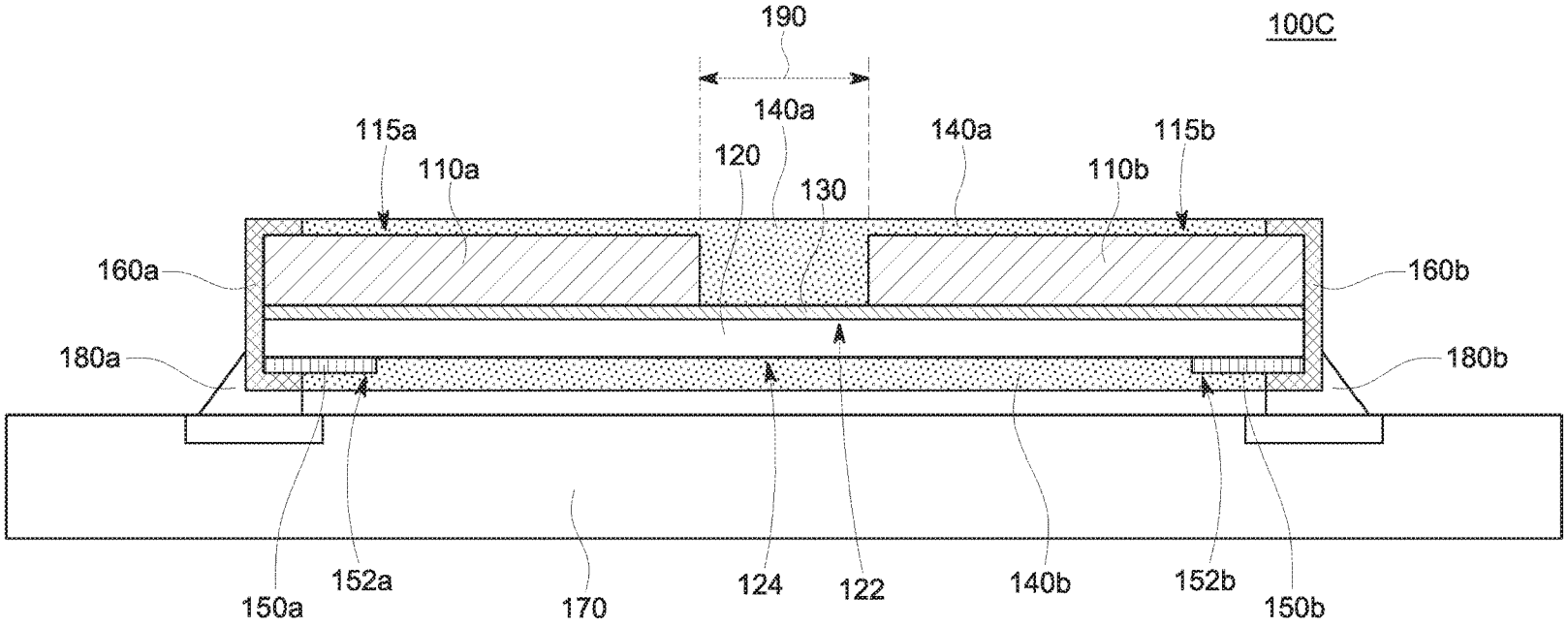
FIG. 1C shows a cross-sectional view of an example resistor attached to a circuit board.

Further, the resistor 100 shown in FIGS. 1A-1C may reduce or eliminate risk of failure of the resistor due to the thermal coefficient of expansion (TCE).

In FIG. 1C, a dielectric material coating 140 is shown as dotted shading and it may be understood that the dielectric coating 140 may be applied to selected portions or all of the external surfaces of the resistor 100. A dielectric material 140 may be deposited on a surface or surfaces of the resistor 100, for example, by coating. The dielectric material 140 may fill spaces or gaps to electrically isolate components from each other. As shown in FIG. 1C, a first dielectric material 140*a* is deposited on an upper portion of the resistor. The first dielectric material 140*a* preferably extends between portions of the solderable terminals 160*a* and 160*b*, and covers the exposed upper surfaces 115*a* and 115*b* of the heat dissipation elements 110*a* and 110*b*. The first dielectric material 140*a* also fills in the gap 190 between, and keeps separate, the heat dissipation elements 110*a* and 110*b*, as well as covering the exposed portion of the adhesive 130 facing the gap 190. A second dielectric material 140*b* is deposited along the bottom surface of the resistive element 120, between portions of the solderable terminals 160*a* and 160*b*, and covering exposed portions of the electrode layers 150*a* and 150*b*, and the bottom surface 124 of the resistive element 120.

Based on modeling, it is predicted that approximately about 20% to about 50% of the heat generated during use of the resistor 100 may flow through and be dissipated via the heat dissipation elements 110*a* and 110*b*. Based on modeling, it is predicted that the heat dissipation elements 110*a* and 110*b* will carry none or virtually none of the current flowing through the resistor 100, and that the current flow through the heat dissipation elements 110*a* and 110*b* will be at or approach zero when in use. It is expected that all or virtually all of the current flow will be through the electrode layers 150*a* and 150*b* and the resistive element 120.

Figure 2A:
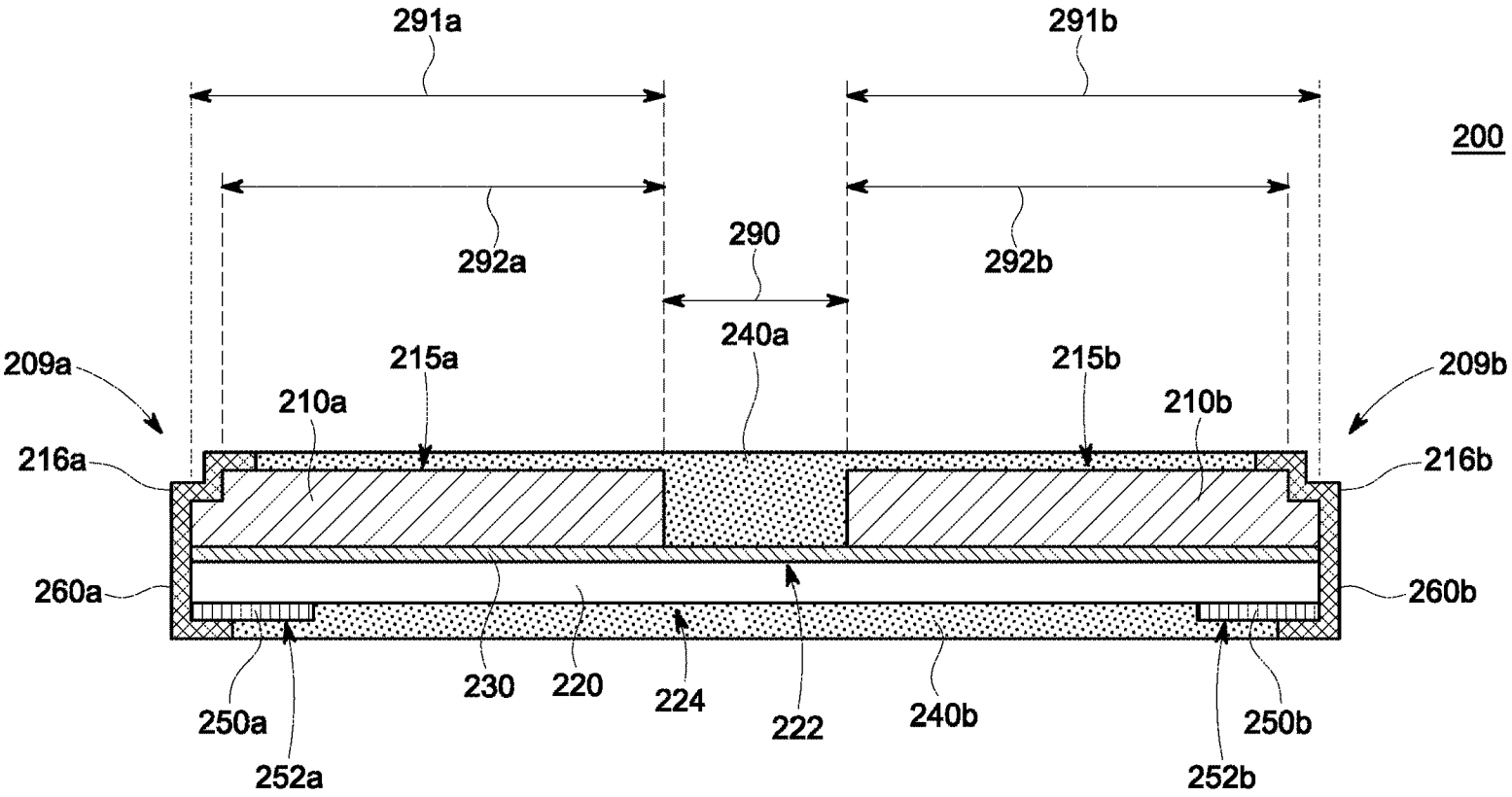
FIG. 2A shows a cross-sectional view of an example resistor with a swage or stepped surface at an upper corner of each heat dissipation element.

FIG. 2A is a diagram of a cross-section of an illustrative resistor 200 according to an alternative embodiment. In this embodiment, the resistor 200 may have swages, shown as 209*a* and 209*b*, at upper corners of the resistor 200. As used herein a swage is considered to include a step, portions of two different heights, an indentation, a groove, a ridge, or other shaped portion or molding. In one example, the swages 209*a* and 209*b* may be considered to be steps in the upper and outer corners of the heat dissipation elements 210*a* and 210*b*. The solderable elements 260*a* and 260*b* covering the heat dissipation elements 210*a* and 210*b* will also have corresponding swages in the upper and outer corners. The portions of the solderable elements 260*a* and 260*b* having the swages may be brought closer in proximity to the resistive element 220, as will be described in greater detail herein.

The swages 209*a* and 209*b* provide the heat dissipation elements 210*a* and 210*b* with upper inner top surfaces 215*a* and 215*b* lying or aligned along the same level or plane which preferably is positioned lower than the top of a dielectric material 240*a*, and lower outer top surfaces 216*a* and 216*b* lying or aligned along the same level or plane positioned lower than the uppermost inner top surface. As shown, the heat dissipation elements 210*a* and 210*b* including the swages 209*a* and 209*b* provide that the upper inner top surfaces 215*a* and 215*b* have a height greater than the height of the lower outer top surfaces 216*a* and 216*b*. The swages 209*a* and 209*b* further provide the heat dissipation elements 210*a* and 210*b* with a complete length shown as 291*a* and 291*b*, and a length to the beginning of the swages 209*a*, 209*b* portion shown as 292*a* and 292*b*.

Figure 2B:
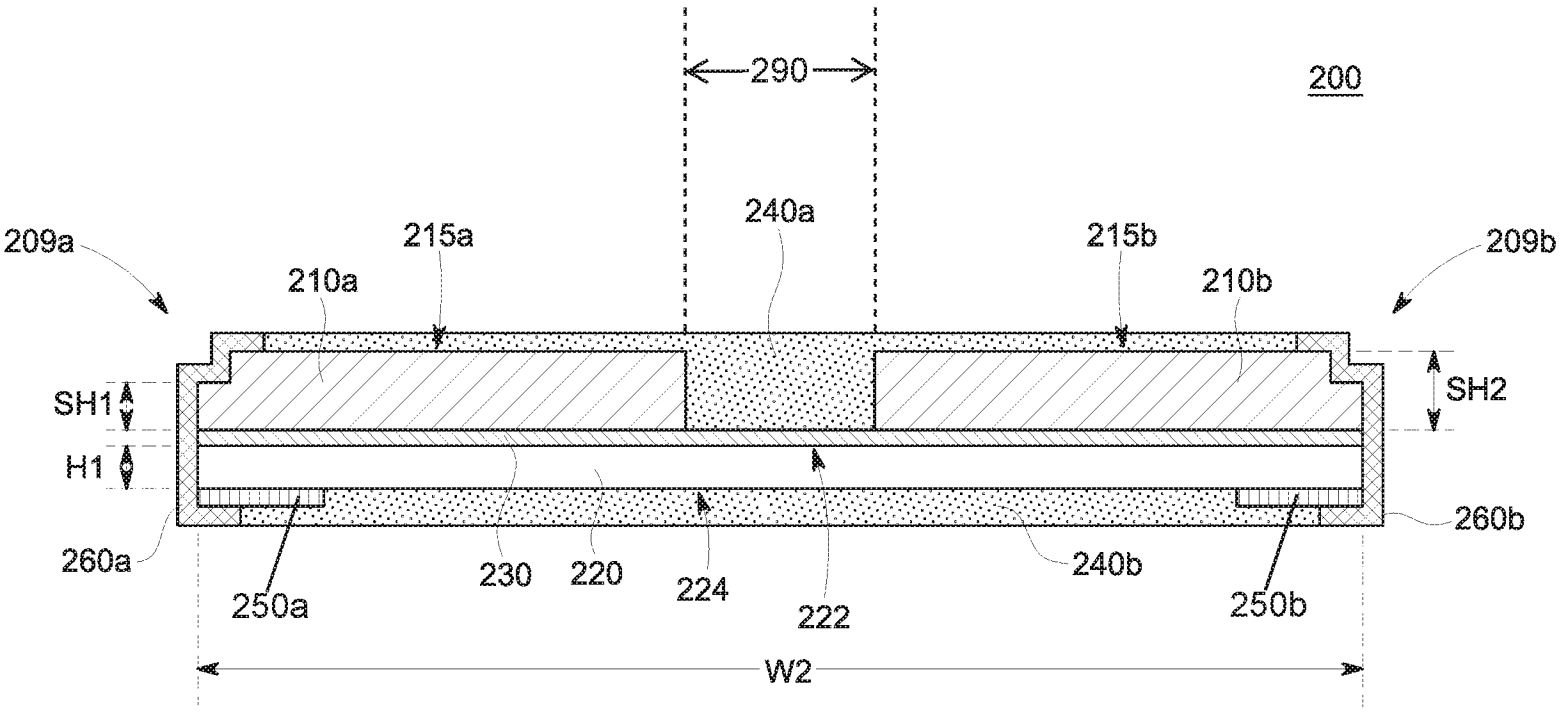
FIG. 2B shows a cross-sectional view of an example resistor with a swage or stepped surface at an upper corner of each heat dissipation element.

The swages 209*a* and 209*b* provide the heat dissipation elements 210*a* and 210*b* with an outer portion having a height shown as SH1 in FIG. 2B, and an inner portion having a height shown as SH2. In the preferred embodiment, SH2 is greater than SH1. The overall height SH2 of the heat dissipation elements 210*a* and 210*b* may be, for example, an average of two times greater than the height H1 of the resistive element 220.

It is appreciated that the swages 209*a* and 209*b* may have one or more variations in shape, providing the heat dissipation elements 210*a* and 210*b* with an upper portion that is stepped, angled or rounded. The solderable elements 260*a* and 260*b* covering the heat dissipation elements 210*a* and 210*b* in those instances may have corresponding shapes.

The resistor 200 illustrated in FIG. 2B includes a resistive element 220 preferably positioned across an area of the resistor 200, such as along at least portions of the length and width of the resistor 200. The resistive element has a top surface 222 and a bottom surface 224. The resistive element 220 is preferably a foil resistor. The resistive element may be formed from, by way of non-limiting example, copper, alloys of copper, nickel, aluminum, or manganese, or combinations thereof. Additionally, the resistive element may be formed from alloys of copper-nickel-manganese (CuNiMn), copper manganese tin (CuMnSn), copper nickel (CuNi), nickel-chromium-aluminum (NiCrAl), or nickel-chromium (NiCr), or other alloys known to those of skill in the art acceptable for use as a foil resistor. The resistive element 220 has a width "W2" as designated in FIG. 2B. In addition, the resistive element 220 has a height or thickness of "H1" as designated in FIG. 2B. The resistive element 220 has outer side surfaces or faces, facing in opposite directions, that are generally planar or essentially flat.

A first solderable terminal 260*a* and the second solderable terminal 260*b* cover opposite side ends of the resistor. These may be formed in the same manner as described with respect to solderable terminals 160*a* and 160*b*. The solderable terminals 260*a*, 260*b* extend from the electrodes 250*a*, 250*b*, along the sides of the resistor, and along at least part of the upper inner top surfaces 215*a* and 215*b* of the heat dissipation elements 210*a*, 210*b*.

The first heat dissipation element 210*a* and the second heat dissipation element 210*b* are positioned adjacent opposite side ends of the resistive element 220, with a gap 290 preferably provided between the first heat dissipation element 210*a* and a second heat dissipation element 210*b*. The heat dissipation elements 210*a* and 210*b* are formed from a thermally conductive material, and may preferably comprise copper, such as, for example, C110 or C102 copper. However, other metals with heat transfer properties, such as, for example, aluminum, may be used for the conductive elements, and those of skill in the art will appreciate other acceptable metals for use as the conductive elements. The first heat dissipation element 210*a* and a second heat dissipation element 210*b* may extend all the way to the outer side edges (or outer side surfaces) of the resistive element 220. The outermost side edges (side surfaces) of the heat dissipation elements 210*a*, 210*b* and the outer side edges (or outer side surfaces) of the resistive element 220 may be aligned and form flat outer side surfaces of the resistor.

The heat dissipation elements 210*a* and 210*b* may be laminated, bonded, joined, or attached to the resistive element 220 via an adhesive material 230, which may comprise, by way of non-limiting example, materials such as DUPONT™, PYRALUX™, BOND PLY™, or other acrylic, epoxy, polyimide, or alumina filled resin adhesives in sheet or liquid form. Additionally, the adhesive material 230 may be composed of a material with electrically insulating and thermally conductive properties. The adhesive material 230 preferably extends along the entire width "W2" of the top surface 222 of the resistive element 220.

Figure 2C:
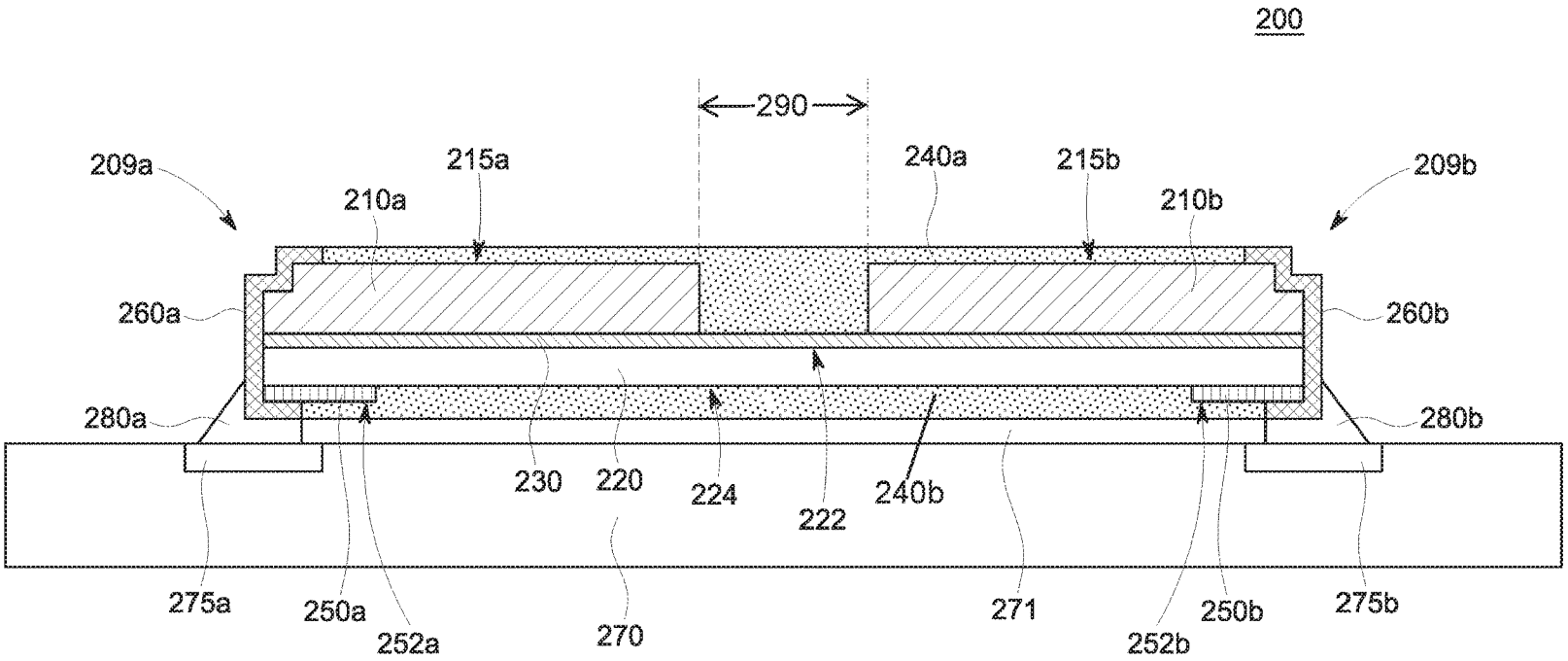
FIG. 2C shows a cross-sectional view of a resistor with a swage or stepped surface at an upper corner of each heat dissipation element, attached to a circuit board.

FIG. 2C shows that the heat dissipation elements 210*a* and 210*b* may be positioned so that, when the resistor is attached to a circuit board 270, the heat dissipation elements 210*a* and 210*b* are at the top of the resistor and distanced from a board 270.

A first 250*a* and a second 250*b* electrode layer, which may also be referred to as conductive layers, are disposed along at least portions of the bottom surface 224 of the resistive element 220 at opposite side ends. The electrode layers 250*a* and 250*b* have opposite outer edges that preferably align with the opposite outer side edges (or outer side surfaces) of resistive element 220. Preferably, the first 250*a* and second 250*b* electrode layers are plated to the bottom surface 224 of the resistive element 220. In a preferred embodiment, copper may be used for the electrode layers. However, any platable and highly conductive metals may be used, as will be appreciated by those of skill in the art.

The outer side edges (or outer side surfaces) of the resistive element 220 and heat dissipation elements 210*a* and 210*b*, form solderable surfaces configured to receive solderable terminal 260*a* and 260*b* that may also be known as terminal platings. Portions of the outer side edges (or outer side surfaces) beneath the swage 209*a* and 209*b* of solderable terminals 260*a* and 260*b* may preferably form planar, flat, or smooth outer side surfaces. As used herein, "flat" means "generally flat" and "smooth" means "generally smooth," i.e., within normal manufacturing tolerances. It is appreciated that the outer side surfaces of the solderable terminals 260*a* and 260*b* may be somewhat or slightly rounded, bowed, curved, or wavy beneath the swage 209*a* and 209*b* based on the process used to form the resistor, while still being considered to be "flat."

As shown in FIG. 2C the solderable terminals 260*a* and 260*b* may be separately attached at the lateral ends of the resistor 200 to allow the resistor 200 to be soldered to a circuit board 270. The solderable terminals 260*a* and 260*b* preferably include portions that extend at least partially along bottom surfaces 252*a* and 252*b* of the electrode layers 250*a* and 250*b*. The solderable terminals 260*a* and 260*b* preferably include portions that extend partially along upper surfaces 215*a* and 215*b* of the heat dissipation elements 210*a* and 210*b*.

As shown in FIG. 2C, the use of electrode layers, such as 250*a* and 250*b*, on the side of the resistive element may be closest to the circuit board 270, also referred to as PCB 270, and aid in creating a strong solder joint and centering the resistor 200 on the PCB pads 275*a* and 275*b* during solder reflow. The resistor 200 is mounted to the circuit board 270 using solder connections 280*a* and 280*b* between the solderable terminals 260*a* and 260*b* and corresponding solder pads 275*a* and 275*b* on the circuit board 270.

The heat dissipation elements 210*a* and 210*b* are coupled to the resistive element 220 via the adhesive 230. It is appreciated that the heat dissipation elements 210*a* and 210*b* may be thermally and/or mechanically and/or electrically coupled/connected or otherwise bonded, joined or attached to the resistive element 220. The solderable terminals 260*a* and 260*b* provide further thermal connection between the resistive element 220 and the heat dissipation elements 210*a* and 210*b*.

The resistor 200 preferably has dielectric material coatings 240*a* and 240*b* applied (e.g., by coating) to certain external or exposed surfaces of the resistor 200 as shown. The dielectric material 240*a* and 240*b* may fill spaces or gaps to electrically isolate components from each other. The first dielectric material 240*a* is deposited on an upper portion of the resistor. The first dielectric material 240*a* preferably extends between portions of the solderable terminals 260*a* and 260*b*, and covers the exposed upper surfaces 215*a* and 215*b* of the heat dissipation elements 210*a* and 210*b*. The first dielectric material 240*a* also fills in the gap 290 between, and separates, the heat dissipation elements 210*a* and 210*b*, as well as covering the exposed portion of the adhesive 230 facing the gap 290. The second dielectric material 240*b* is deposited along the bottom surface 224 of the resistive element 220, between portions of the solderable terminals 260*a* and 260*b*, and covering exposed portions of the electrode layers 250*a* and 250*b*. There may be a gap 271 between the second dielectric material 240*b* and the circuit board 270 when the resistor is mounted.

Figure 2D:
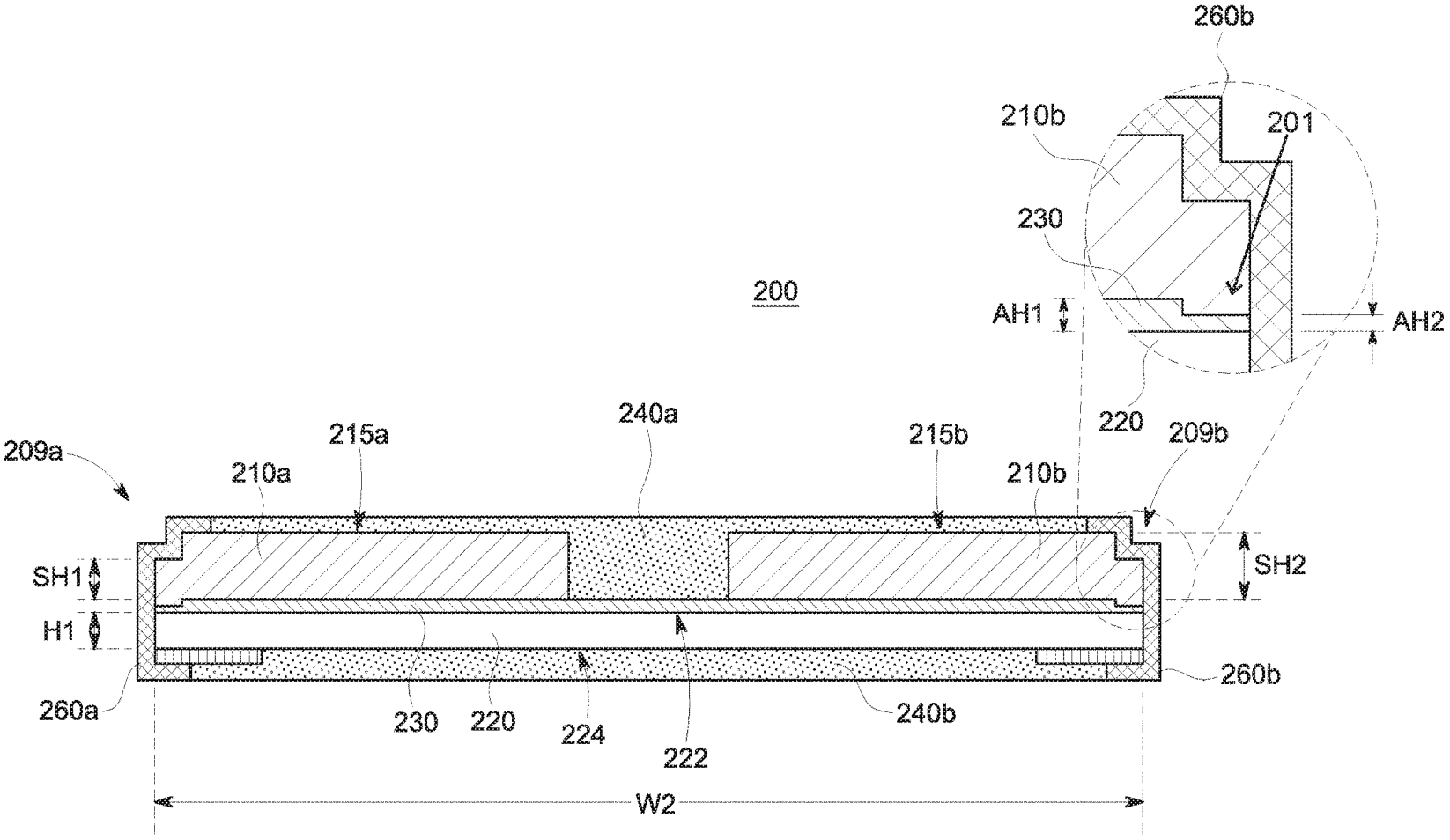
FIG. 2D shows a cross-sectional view of a resistor with a swage or stepped surface at an upper corner of each heat dissipation element, with a portion of each heat dissipation element in closer proximity to the resistive element.

FIG. 2D is a diagram of a cross-section of the illustrative resistor 200 in an embodiment wherein a portion of each of the heat dissipation elements 210*a* and 210*b* is brought into closer proximity to the resistive element 220. The swages 209*a* and 209*b* may be formed by compressing a portion of the heat dissipation elements 210*a* and 210*b* or otherwise pressing those portions toward the resistive element 220, so that each heat dissipation element has at least a portion, such as an extension portion, that extends toward the resistive element 220. The adhesive layer 230 may also be compressed in certain areas 201. The compression force may be the result of a die and a punch, which may press the heat dissipation elements 210*a* and 210*b* down from the upper surfaces 215*a* and 215*b* to form the swages 209*a* and 209*b*. In this example, the adhesive layer 230 may be compressed or thinner in the areas 201 below the swages 209*a* and 209*b* such that a height AH2 of the adhesive layer 230 below the swages 209*a* and 209*b* is less than a height AH1 of the remaining portion of the adhesive layer. The extension of portions of the heat dissipation elements 210*a* and 210*b* toward the resistive element 220 brings the heat dissipation elements 210*a* and 210*b* and the resistive element 220 into a closer proximity (i.e., AH2), which promotes better heat transfer from the resistive element to the heat dissipation elements 210*a* and 210*b*.

Figure 2E:
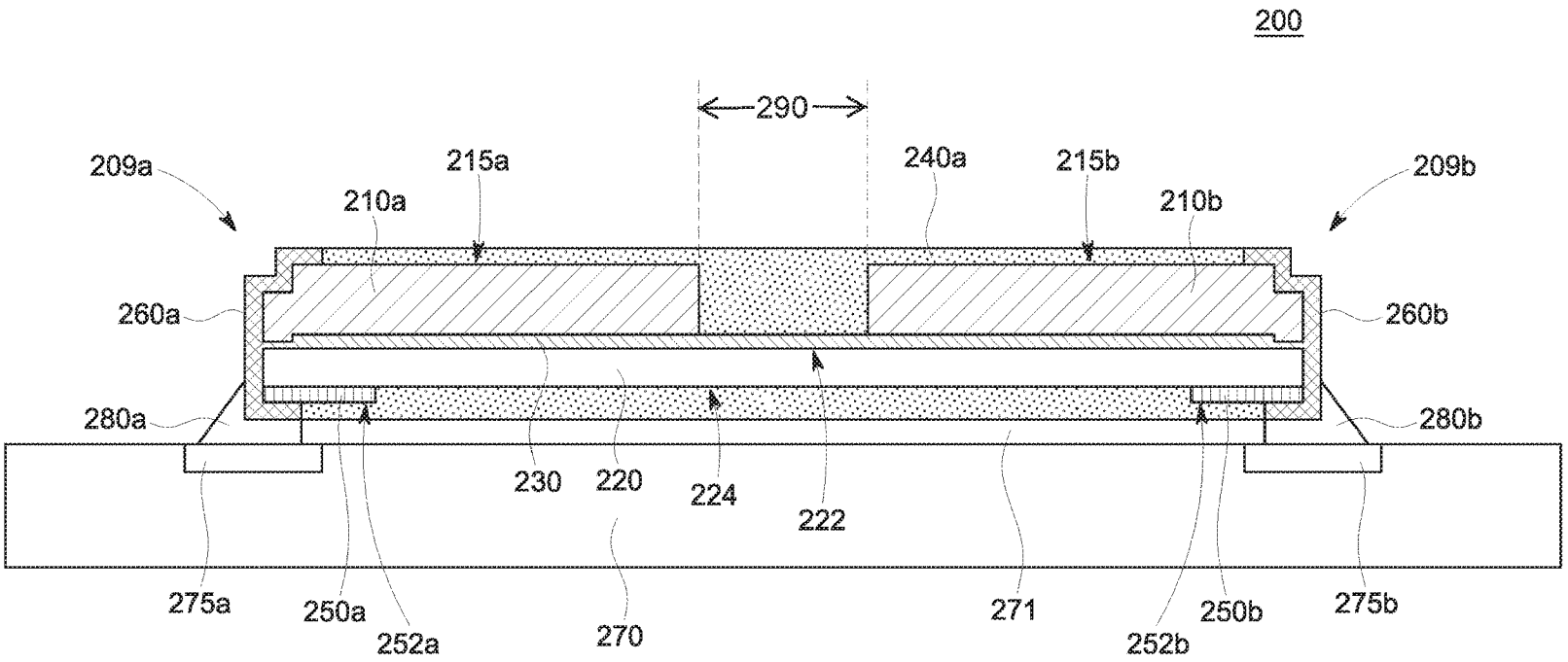
FIG. 2E shows a cross-sectional view of a resistor with a swage or stepped surface at an upper corner of each heat dissipation element with a portion of each heat dissipation element in closer proximity to the resistive element, attached to a circuit board.

FIG. 2E shows the resistor having the portion of each of the heat dissipation elements 210*a* and 210*b* brought into closer proximity to the resistive element 220 attached to a circuit board 270. The structure shown in FIG. 2E may have components similar to those described above with reference to FIG. 2C and therefore may also utilize the descriptions above.

Figure 2F:
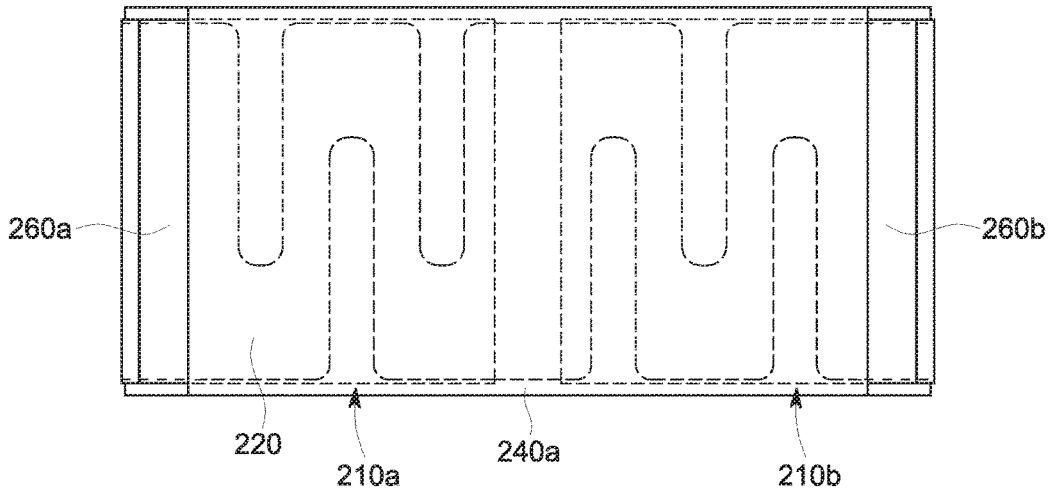
FIG. 2F shows a top view of the example resistor shown in FIGS. 2A and 2D.

FIG. 2F shows a top view of the example resistor shown in FIGS. 2A and 2D with portions shown in phantom to view the interior of the resistor.

Figure 2G:
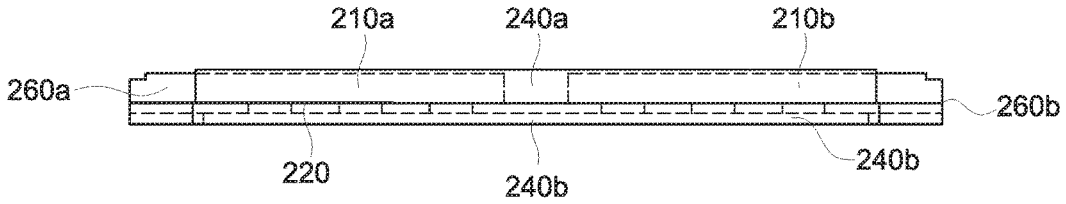
FIG. 2G shows a side view of the example resistor shown in FIGS. 2A and 2D.
Figure 2H:
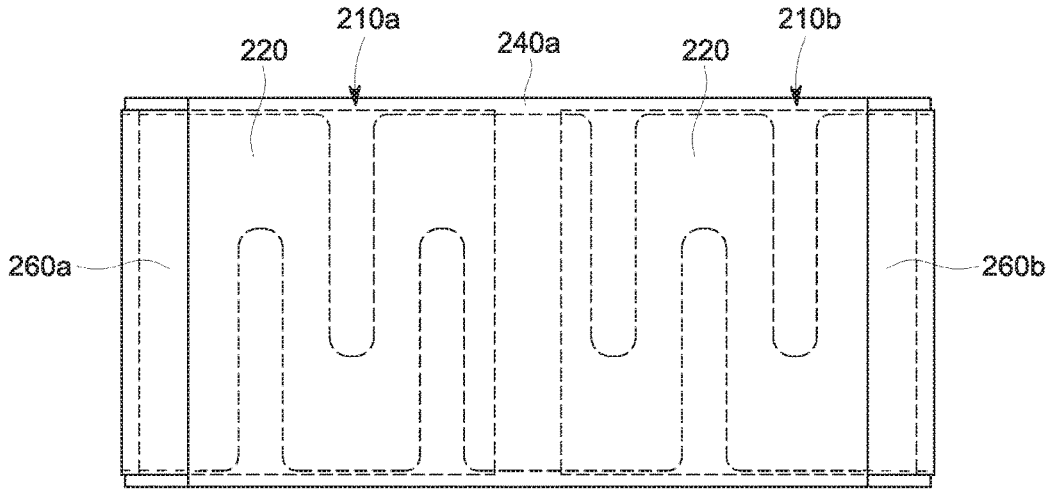
FIG. 2H shows a bottom view of the example resistor shown in FIGS. 2A and 2D.

FIG. 2G shows a side view of the example resistor shown in FIGS. 2A and 2D with portions shown in phantom to view the interior of the resistor, FIG. 2H shows a bottom view of the example resistor shown in FIGS. 2A and 2D with portions shown in phantom to view the interior of the resistor.

The thermal, electrical, and/or mechanical coupling/connection between the resistive element 220 and the lateral end of each of the heat dissipation elements 210*a* and 210*b* may enable the heat dissipation elements 210*a* and 210*b* to be used both as structural aspects for the resistor 200 and also as heat spreaders.

Figure 3A:
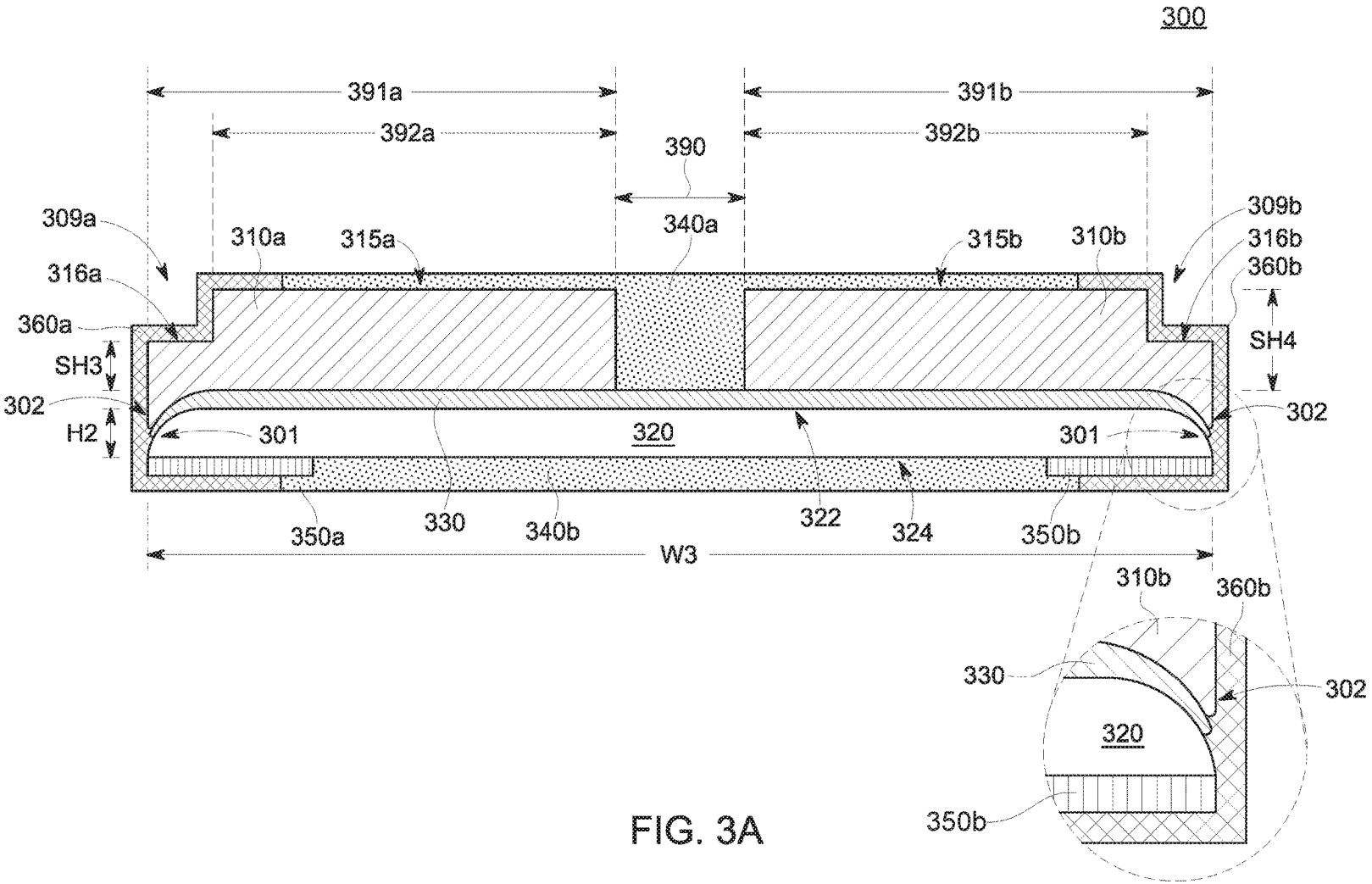
FIG. 3A shows a cross-section of an example resistor showing outer portions of the heat dissipation elements bent toward the resistive element.

FIG. 3A is a diagram of a cross-section of an illustrative resistor 300 according to another embodiment. The resistor 300 includes a resistive element 320 positioned across an area of the resistor 300, such as along at least portions of the length and width of the resistor 300. The resistive element 320 has a top surface 322 and a bottom surface 324. The resistive element 320 is preferably a foil resistor. The resistive element may be formed from, by way of non-limiting example, copper, alloys of copper, nickel, aluminum, or manganese, or combinations thereof. Additionally, the resistive element may be formed from alloys of copper-nickel-manganese (CuNiMn), copper manganese tin (CuMnSn), copper nickel (CuNi), nickel-chromium-aluminum (NiCrAl), or nickel-chromium (NiCr), or other alloys known to those of skill in the art acceptable for use as a foil resistor. The resistive element 320 has a width "W3." In addition, the resistive element 320 has a height or thickness of "H2." The resistive element 320 has outer side surfaces or faces, facing in opposite directions, that are generally planar or essentially flat.

The first heat dissipation element 310*a* and the second heat dissipation element 310*b* are positioned adjacent opposite side ends of the resistive element 320, with a gap 390 preferably provided between the first heat dissipation element 310*a* and a second heat dissipation element 310*b*. The heat dissipation elements 310*a* and 310*b* are formed from a thermally conductive material, and may preferably comprise copper, such as, for example, C110 or C102 copper. However, other metals with heat transfer properties, such as, for example, aluminum, may be used for the conductive elements, and those of skill in the art will appreciate other acceptable metals for use as the conductive elements.

The heat dissipation elements 310*a* and 310*b* may be laminated, bonded, joined, or attached to the resistive element 320 via an adhesive material 330, which may comprise, by way of non-limiting example, materials such as DUPONT™, PYRALUX™, BOND PLY™, or other acrylic, epoxy, polyimide, or alumina filled resin adhesives in sheet or liquid form. Additionally, the adhesive material 330 may be composed of a material with electrically insulating and thermally conductive properties. The adhesive material 330 preferably extends along the entire width W3 of the top surface 322 of the resistive element 320.

A first 350*a* and a second 350*b* electrode layer, which may also be referred to as conductive layers, are disposed along at least portions of the bottom surface 324 of the resistive element 320 at opposite side ends. The electrode layers 350*a* and 350*b* have opposite outer edges that preferably align with the opposite outer side edges (or outer side surfaces) of resistive element 320. Preferably, the first 350*a* and second 350*b* electrode layers are plated to a bottom surface 324 of the resistive element 320. In a preferred embodiment, copper may be used for the electrode layers. However, any platable and highly conductive metals may be used, as will be appreciated by those of skill in the art.

The resistor 300 preferably has dielectric material coatings 340*a* and 340*b* applied (e.g., by coating) to certain external or exposed surfaces of the resistor 300 as shown. The dielectric material 340*a* and 340*b* may fill spaces or gaps to electrically isolate components from each other. The first dielectric material 340*a* is deposited on an upper portion of the resistor 300. The first dielectric material 340*a* covers upper surfaces 315*a* and 315*b* of the heat dissipation elements 310*a* and 310*b*. The first dielectric material 340*a* also fills in the gap 390 between, and separates, the heat dissipation elements 310*a* and 310*b*, as well as covering the exposed portion of the adhesive layer 330 facing the gap 390. The second dielectric material 340*b* is deposited on the bottom surface 324 of the resistive element 320 and covers portions of the electrode layers 350*a* and 350*b*.

As shown in FIG. 3A, a portion of each of the heat dissipation elements 310*a* and 310*b* may be brought into closer proximity to the resistive element 320. Swages 309*a* and 309*b* may be formed by compressing a portion of the heat dissipation elements 310*a* and 310*b* or otherwise pressing those portions toward the resistive element 320. The adhesive layer 330 may also be compressed in certain areas 301. The compression force may be a result of a die and a punch, which may press the heat dissipation elements 310*a* and 310*b* down from the upper surfaces 315*a* and 315*b* to form the swages 309*a* and 309*b*. In this example, the adhesive layer 330 may be thinner in the areas 301 below the swages 309*a* and 309*b* and may be bent down along with the heat dissipation elements 310*a* and 310*b*.

Each heat dissipation element may have at least a portion, such as an extension portion 302, that extends toward, adjacent to or around, as the case may be, the resistive element 320. The extended portion 302 of the first heat dissipation element 310*a* and the extended portion 302 of the second heat dissipation element 310*b* may be pressed or otherwise positioned to extend along the outer side edges (or outer side surfaces) of the adhesive layer 330. In an embodiment, extended portion 302 of the first heat dissipation element 310*a* and the extended portion 302 of the second heat dissipation element 310*b* may extend to the resistive element 320. The outer side edges (side surfaces) of the extended portion 302 of the heat dissipation elements 310*a*,

310*b* and the outer side edges (or outer side surfaces) of the resistive element 320 may be aligned and form outer side surfaces of the resistor 300.

The adhesive layer 330 and bottom portions of the heat dissipation elements 310*a* and 310*b* may curve down towards the resistive element 320 in the bent areas 301. As shown in the magnified view, the bottom edges of the heat dissipation elements 310*a* and 310*b*, the outer edges of the adhesive layer 330 may be rounded off.

As used herein a swage is considered to include a step, indentation, groove, ridge, or other shaped molding. In one example, the swages 309*a* and 309*b* may be considered to be steps in the upper and outer corners of the heat dissipation elements 310*a* and 310*b*.

The swages 309*a* and 309*b* provide the heat dissipation elements 310*a* and 310*b* with upper inner top surfaces 315*a* and 315*b* lying or aligned along the same level or plane which preferably is positioned lower than the top of a dielectric material 340*a*, and lower outer top surfaces 316*a* and 316*b* lying or aligned along the same level or plane positioned lower than the uppermost inner top surface. As shown, the heat dissipation elements 310*a* and 310*b* including the swages 309*a* and 309*b* provide that the upper inner top surfaces 315*a* and 315*b* have a height greater than the height of the lower outer top surfaces 316*a* and 316*b*. The swages 309*a* and 309*b* further provide the heat dissipation elements 310*a* and 310*b* with a complete length shown as 391*a* and 391*b*, and a length to the beginning of the swages 309*a*, 309*b* portion shown as 392*a* and 392*b*.

The swages 309*a* and 309*b* provide the heat dissipation elements 310*a* and 310*b* with an outer portion having a height SH3 and an inner portion having a height shown as SH4. In the preferred embodiment, SH4>SH3. The overall height SH4 of the heat dissipation elements 310*a* and 310*b* may be, for example, an average of two times greater than the height 112 of the resistive element 320.

It is appreciated that the swages 309*a* and 309*b* may have one or more variations in shape, providing the heat dissipation elements 310*a* and 310*b* with an upper portion that is stepped, angled or rounded.

A first solderable terminal 360*a* and a second solderable terminal 360*b* may be formed on opposite side ends of the resistor 300 in the same manner as described with respect to solderable terminals 160*a*, 160*b* and 260*a*, 260*b*. The solderable terminals 360*a*, 360*b* extend from the electrodes 350*a*, 350*b*, along the sides of the resistor, and along at least part of the upper inner top surfaces 315*a* and 315*b* of the heat dissipation elements 310*a*, 310*b*. The first dielectric material 340*a* preferably extends between the solderable terminals 360*a* and 360*b* on the upper surface of the resistor 300. The second dielectric material 340*b* extends along the bottom surface 324 of the resistive element 320 between portions of the solderable terminals 360*a* and 360*b*.

The outer side edges (or outer side surfaces) of the resistive element 320 and the heat dissipation elements 310*a* and 310*b*, form solderable surfaces configured to receive the solderable terminals 360*a* and 360*b* that may also be known as terminal platings. Portions of the outer side edges (or outer side surfaces) beneath the swage 309*a* and 309*b* of solderable terminals 360*a* and 360*b* may preferably form planar, flat, or smooth outer side surfaces. As used herein, "flat" means "generally flat" and "smooth" means "generally smooth," i.e., within normal manufacturing tolerances. It is appreciated that the outer side surfaces of the solderable terminals 360*a* and 360*b* may be somewhat or slightly rounded, bowed, curved, or wavy beneath the swage 309*a* and 309*b* based on the process used to form the resistor, while still being considered to be "flat." The compression of the adhesive layer 330 and the heat dissipation elements 310*a* and 310*b* may bring the heat dissipation elements 310*a* and 310*b* and the resistive element 320 into a closer proximity in bent areas 301. This may promote adhesion of the solderable terminals 360*a*, 360*b* to the heat dissipation elements 310*a* and 310*b* and the resistive element 320.

The solderable terminals 360*a* and 360*b* covering the heat dissipation elements 310*a* and 310*b* will have corresponding swages in the upper and outer corners. In this manner, the portions of the solderable elements 360*a* and 360*b* having the swages are brought closer in proximity to the resistive element 320.

The solderable terminals 360*a* and 360*b* preferably include portions that extend partially along upper surfaces 315*a* and 315*b* of the heat dissipation elements 310*a* and 310*b*.

As described above, the compression and bending of the adhesive layer 330 brings the heat dissipation elements 310*a* and 310*b* and the resistive element 320 in closer proximity to one another. The solderable terminals 360*a* and 360*b* are able to bridge the adhesive material 330.

Figure 3B:
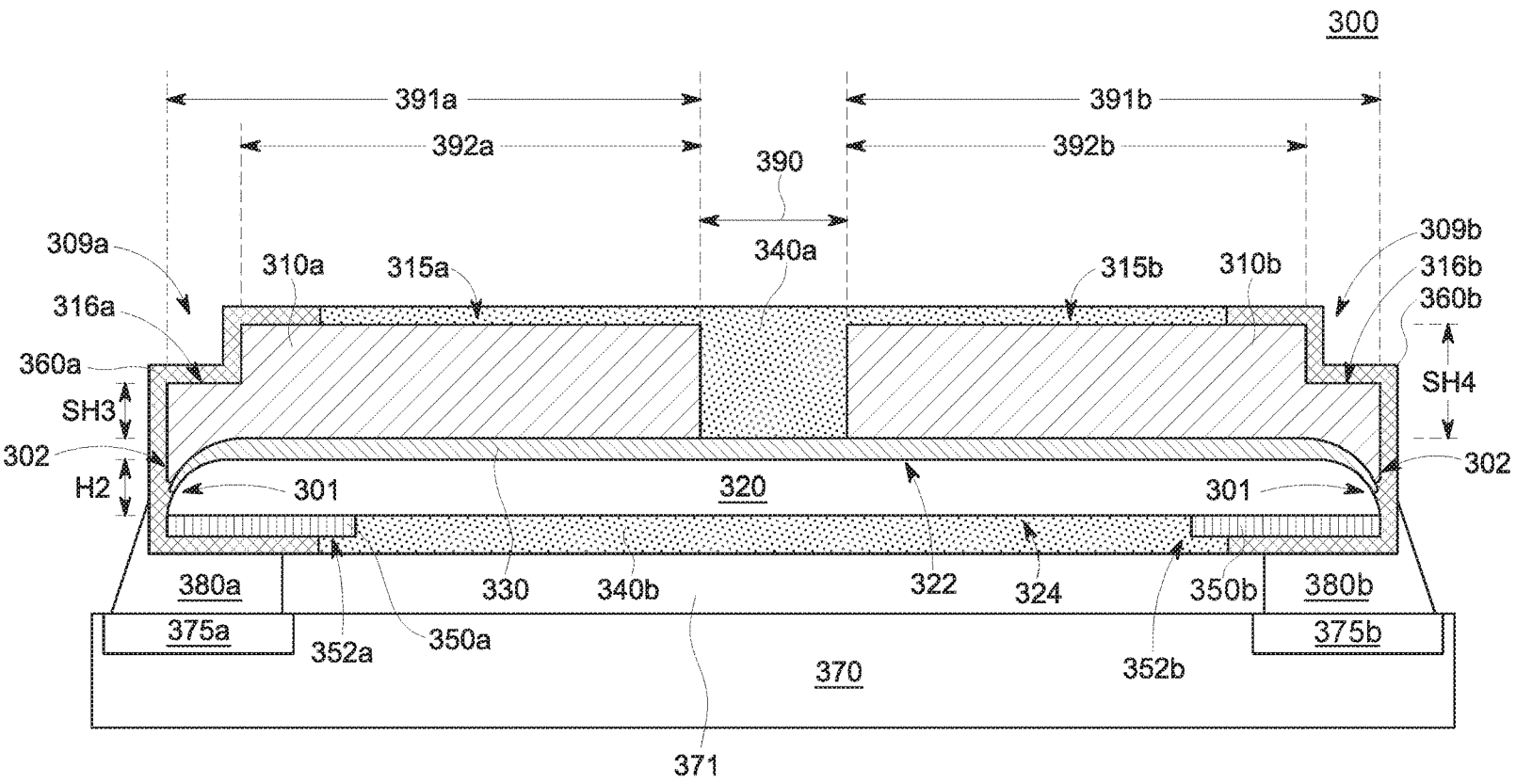
FIG. 3B shows a cross-sectional view of an example resistor showing outer portions of the heat dissipation elements bent toward the resistive element attached to a circuit board.

FIG. 3B shows that the heat dissipation elements 310*a* and 310*b* may be positioned so that, when the resistor is attached to a circuit board 370, also referred to as a PCB 370, the heat dissipation elements 310*a* and 310*b* are at the top of the resistor and distanced from a board 370. There may be a gap 371 between the second dielectric material 340*b* and the circuit board 370 when the resistor is mounted.

The solderable terminals 360*a* and 360*b* may be separately attached at the lateral ends of the resistor 300 to allow the resistor 300 to be soldered to the circuit board 370. The solderable terminals 360*a* and 360*b* preferably include portions that extend at least partially along bottom surfaces 352*a* and 352*b* of the electrode layers 350*a* and 350*b*.

The electrode layers 350*a* and 350*b* may be closest to the circuit board 370, and aid in creating a strong solder joint and centering the resistor 300 on PCB pads 375*a* and 375*b* during solder reflow. The resistor 300 is mounted to the circuit board 370 using solder connections 380*a* and 380*b* between the solderable terminals 360*a* and 360*b* and corresponding solder pads 375*a* and 375*b* on the circuit board 370.

The heat dissipation elements 310*a* and 310*b* are coupled to the resistive element 320 via the adhesive 330. It is appreciated that the heat dissipation elements 310*a* and 310*b* may be thermally and/or mechanically and/or electrically coupled/connected or otherwise bonded, joined or attached to the resistive element 320. The solderable terminals 360*a* and 360*b* provide further thermal connection between the resistive element 320 and the heat dissipation elements 310*a* and 310*b*. The thermal, electrical, and/or mechanical coupling/connection between the resistive element 320 and the lateral end of each of the heat dissipation elements 310*a* and 310*b* may enable the heat dissipation elements 310*a* and 310*b* to be used both as structural aspects for the resistor 300 and also as heat spreaders.

The use of the heat dissipation elements 210*a* and 210*b* as a structural element for resistor 200 and the use of the heat dissipation elements 310*a* and 310*b* as a structural aspect for the resistor 300, may enable the resistive elements 220 and 320 to be made thinner as compared to a self-supporting resistive elements, enabling the resistors 200 and 300 to be made to have a resistance of about 1 mΩ to 30Ω using foil thicknesses between about 0.015 inches and about 0.001 inches. In addition to providing support for the resistive elements 220 and 320, efficient use of the heat dissipation elements 210*a* and 210*b* and the heat dissipation elements 310*a* and 310*b* as heat spreaders may enable the resistors 200 and 300 to dissipate heat more effectively resulting in a higher power rating as compared to resistors that do not use heat spreaders. For example, a typical power rating for a 2512 size metal strip resistor is 1 W. Using the embodiments described herein, the power rating for a 2512 size metal strip resistor may be 3 W.

Further, the resistors 200 and 300 may reduce or eliminate risk of failure of the resistor due to the thermal coefficient of expansion (TCE).

Based on modeling, it is predicted that approximately about 20% to about 50% of the heat generated during use of the resistors 200 and 300 may flow through and be dissipated via the heat dissipation elements 210*a*, 210*b*, 310*a*, and 310*b*. Based on modeling, it is predicted that the heat dissipation elements 210*a*, 210*b*, 310*a*, and 310*b* will carry none or virtually none of the current flowing through the resistors 200 and 300, and that the current flow through the heat dissipation elements 210*a*, 210*b*, 310*a*, and 310*b* will be at or approach zero when in use. It is expected that all or virtually all of the current flow will be through the electrode layers 250*a*, 250*b*, 350*a*, and 350*b* and the resistive elements 220 and 320.

Figure 4A:
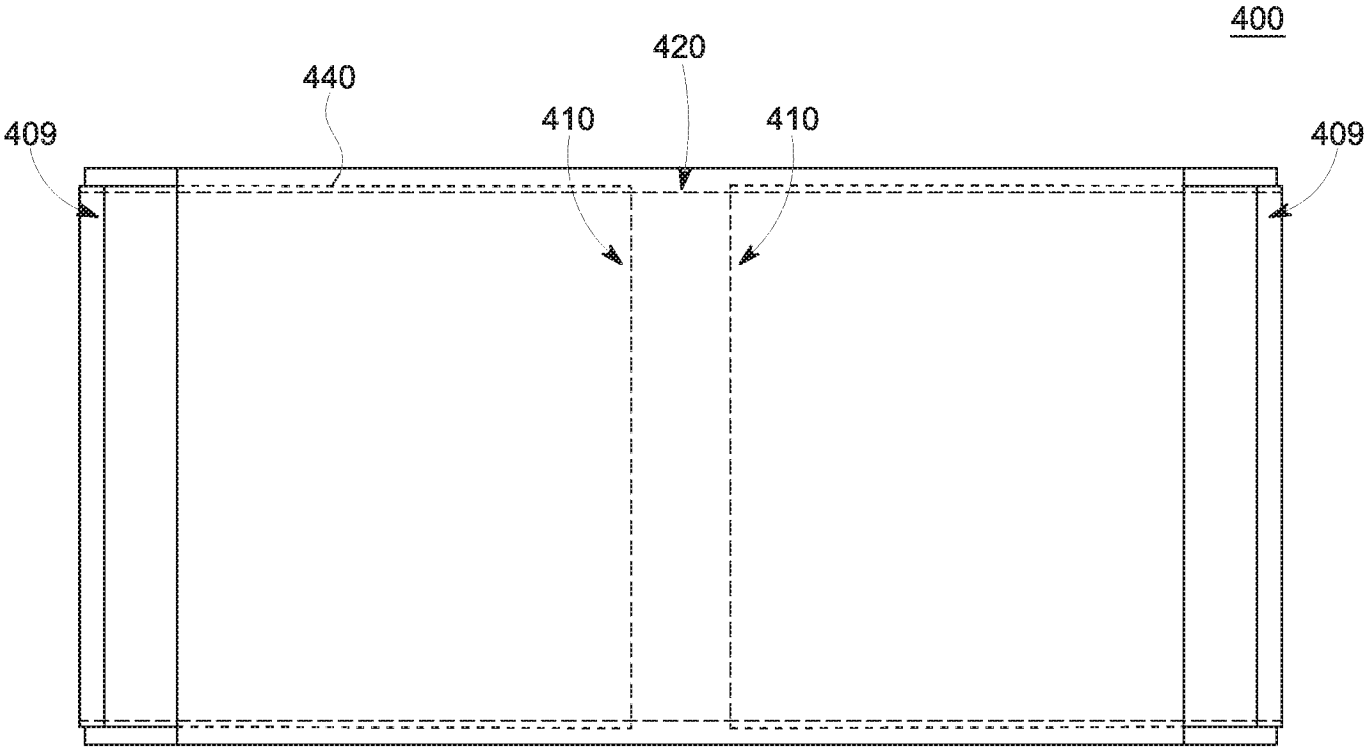
FIG. 4A shows a top view of an example resistor.

FIG. 4A shows a top view of a resistor 400 with partially transparent layers for illustrative purposes. The resistor 400 may have swages 409 and may have a general arrangement as described above with respect to FIGS. 2A-2H or FIGS. 3A-3B. The resistor 400 may be similar to resistor 200 or resistor 300 and therefore may also utilize the descriptions of resistor 200 or resistor 300. FIG. 4A shows a transparent top view of the resistor 400, illustrating heat dissipation elements 410 (similar to the heat dissipation elements 210*a*, 210*b* or 310*a*, 310*b* above), a resistive element 420 (similar to the resistive element 220 or 320 above) and a dielectric material 440 (similar to the dielectric material 240*a*, 240*b* or 340*a*, 340*b* above). The resistive element 420 may have a substantially uniform surface area. As can be seen in FIG. 4A, the heat dissipation elements 410 may have a width that is greater than the width of the resistive element 420 by approximately 2-4%.

Figure 4B:
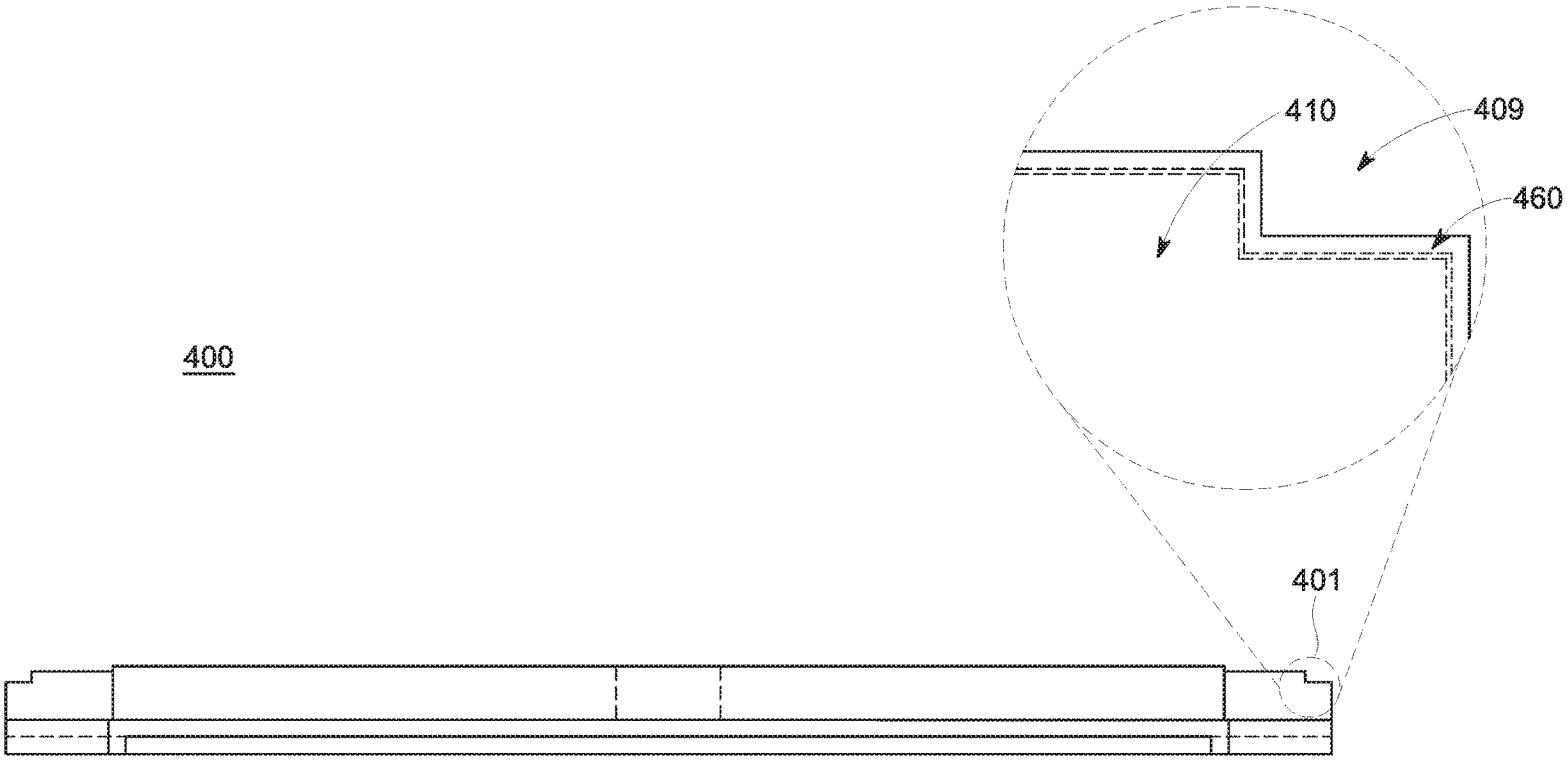
FIG. 4B shows a side view of the resistor of FIG. 4A along with a magnified view of a portion of the resistor.

FIG. 4B shows a side view of the resistor 400 with partially transparent layers for illustrative purposes. A close up view 401 of an upper corner of the resistor 400 is shown where heat dissipation elements 410 may be seen covered by a solderable element 460. A swage 409 may located be at the upper and outer corner of the heat dissipation elements 410 and corresponding solderable element 460.

Figure 4C:
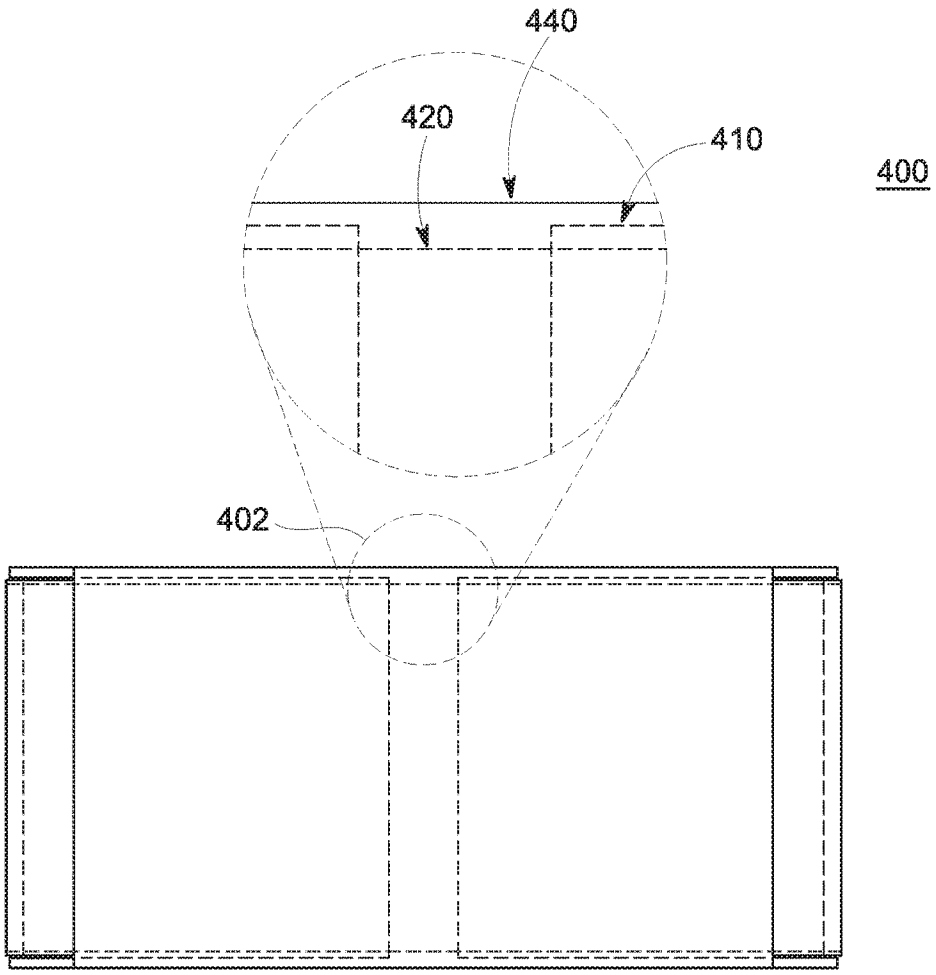
FIG. 4C shows a bottom view of the resistor of the resistor of FIG. 4A along with a magnified view of a portion of the resistor.

FIG. 4C shows a bottom view of the resistor 400 with partially transparent layers for illustrative purposes. A close up view 402 of the resistor 400 shows a detailed view of the middle portion of the resistor 400 showing the resistive element 420, the heat dissipation elements 410, and the dielectric material 440 covering external portions of the conductive elements 410 and the resistive element 420.

Figure 4D:
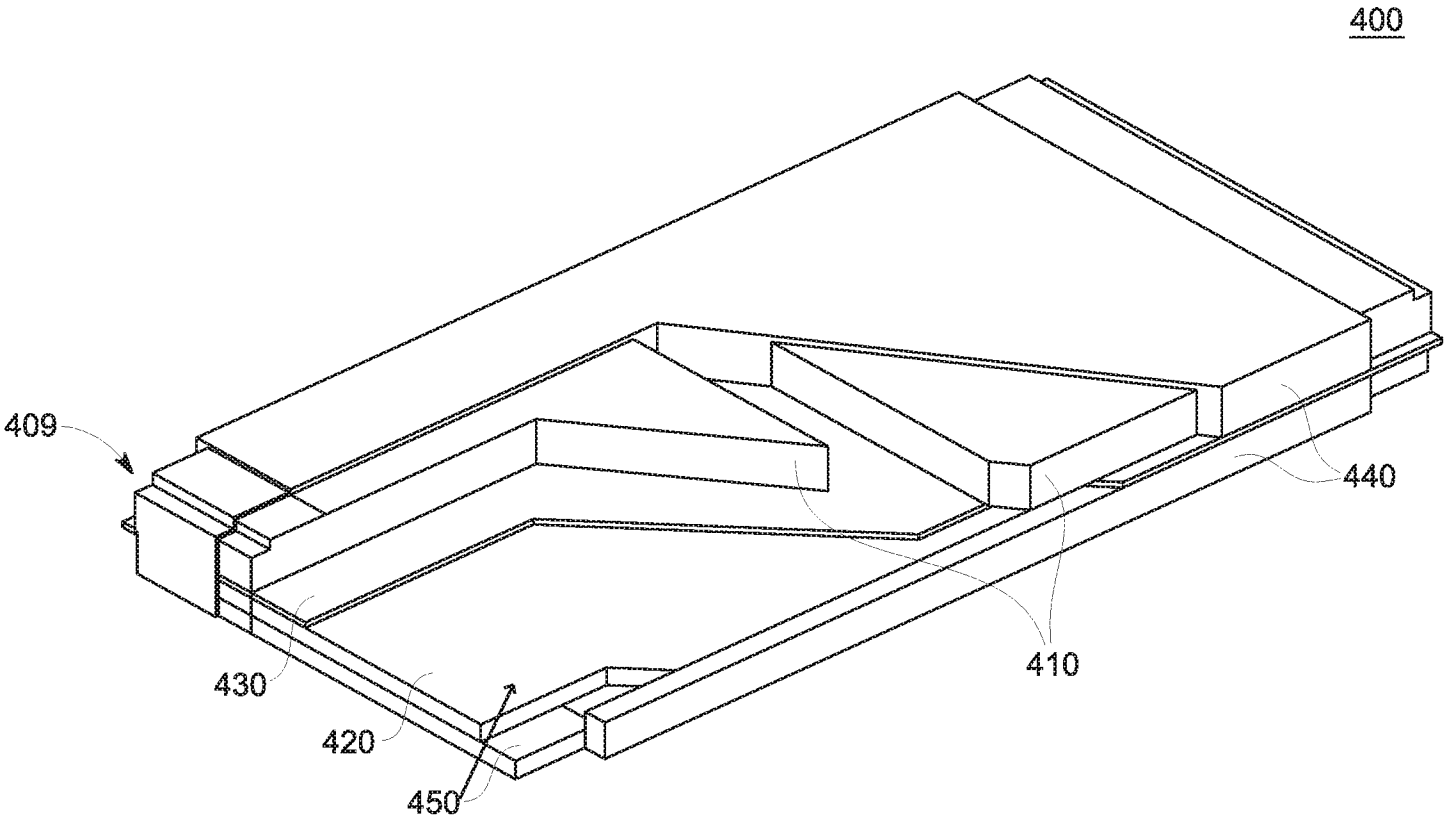
FIG. 4D shows an isometric view of the resistor of FIG. 4A with partial cutaway views for illustration purposes to show inner components or layers.

FIG. 4D shows an isometric view of the resistor 400 with cut away views for illustrative purposes. An adhesive material 430 (similar to adhesive material 230 or 330) formed on an upper surface of the resistive element 420 may thermally bond the heat dissipation elements 410 and the resistive element 420. Electrode layers 450 (similar to electrodes 250*a*, 250*b* or 350*a*, 350*b*) can be seen attached to a lower surface of the resistive element 420.

Figure 5A:
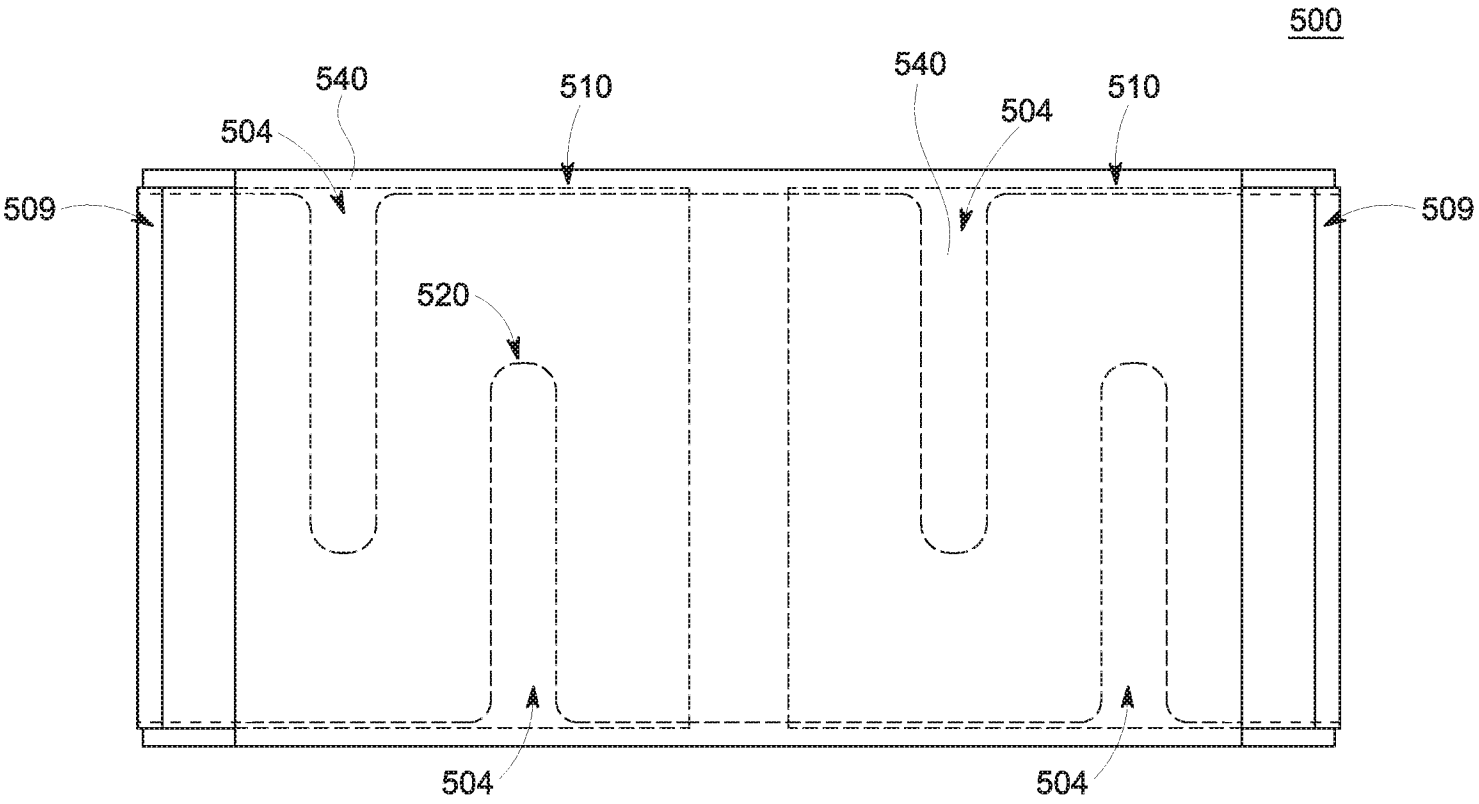
FIG. 5A shows a top view of a resistor.

FIG. 5A shows a top view of a resistor 500 with partially transparent layers for illustrative purposes. The resistor 500 may have swages 509 and may have a general arrangement as described above with respect to FIGS. 2A-2H or FIGS. 3A-3B. The resistor 500 may be similar to resistor 200 or resistor 300 and therefore may also utilize the descriptions of resistor 200 or resistor 300. FIG. 5A shows a transparent top view of the resistor 500, illustrating heat dissipation elements 510 (similar to the heat dissipation elements 210*a*, 210*b* or 310*a*, 310*b* above), a resistive element 520 (similar to the resistive element 220 or 320 above) and a dielectric material 540 (similar to the dielectric material 240*a*, 240*b* or 340*a*, 340*b* above).

The resistive element 520 may be calibrated, for example, by thinning to a desired thickness or by manipulating the current path by cutting through the resistive element 520 in specific locations based, for example, on the target resistance value for the resistor 500. The patterning may be done by chemical etching and/or laser etching. The resistive element 520 may be etched such that two grooves 504 are formed under each of the heat dissipation elements 510. The dielectric material 540 may fill the grooves 504. As can be seen in FIG. 5A, the heat dissipation elements 510 may have a width that is greater than the width of the resistive element 520 by approximately 2-4%.

Figure 5B:
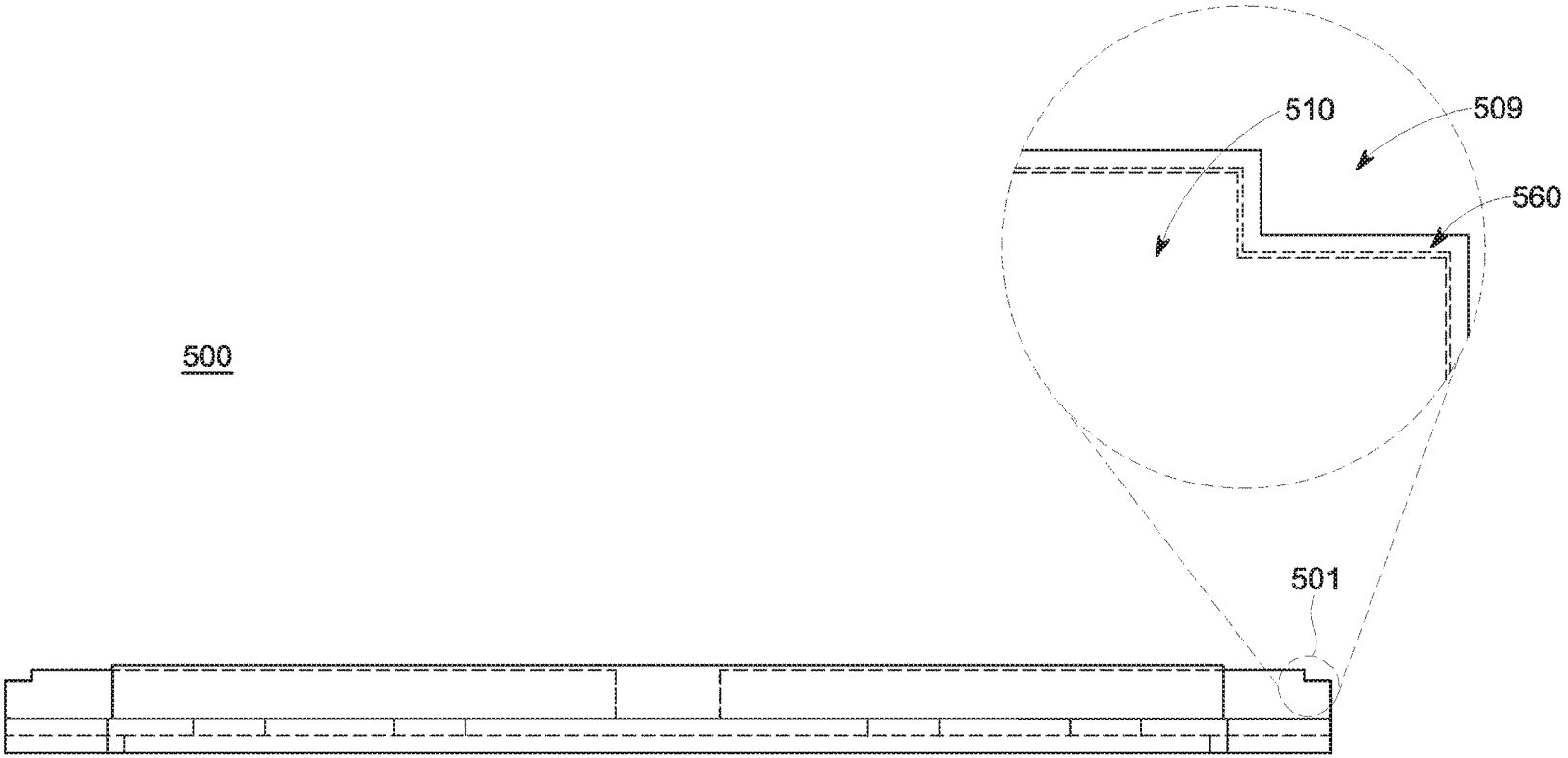
FIG. 5B shows a side view of the resistor of FIG. 5A along with a magnified view of a portion of the resistor.

FIG. 5B shows a side view of the resistor 500 with partially transparent layers for illustrative purposes. A close up view 501 of an upper corner of the resistor 500 is shown where heat dissipation elements 510 may be seen covered by a solderable element 560. A swage 509 may be located at the upper and outer corner of the heat dissipation elements 510 and corresponding solderable element 560.

Figure 5C:
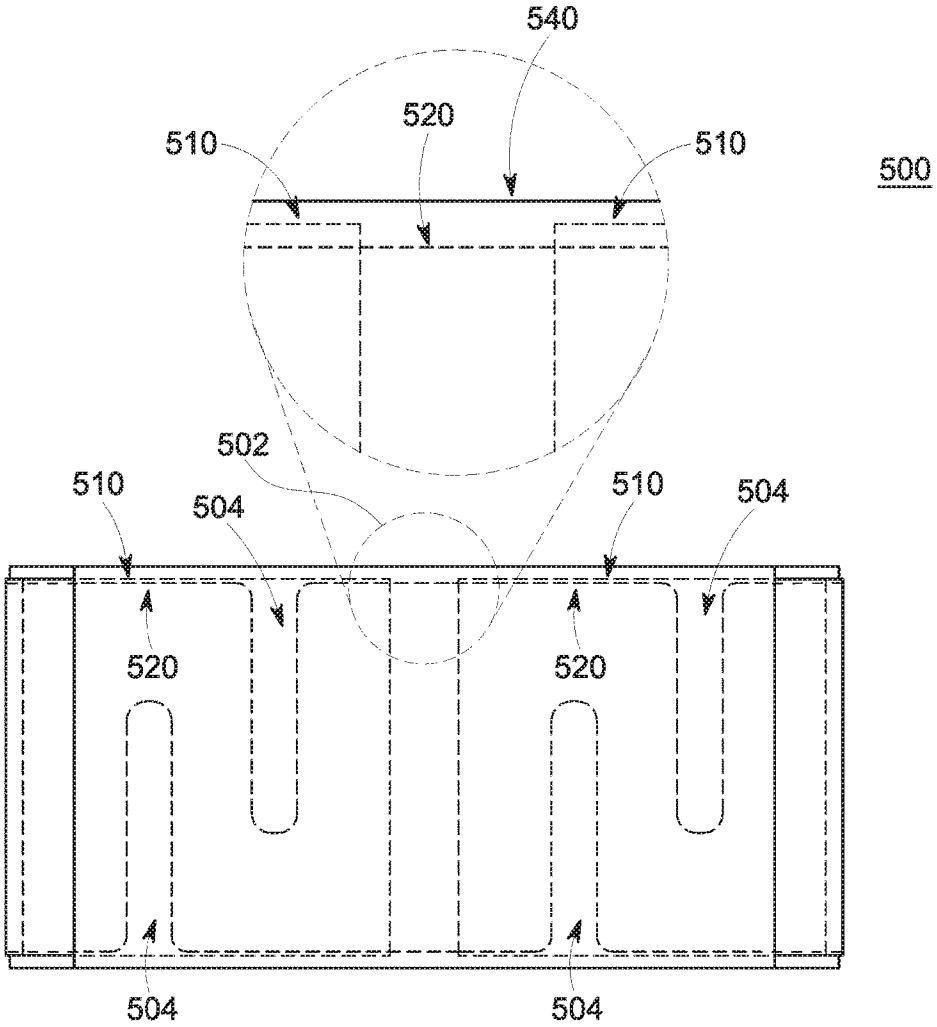
FIG. 5C shows a bottom view of the resistor of FIG. 5A along with a magnified view of a portion of the resistor.

FIG. 5C shows a bottom view of the resistor 500 with partially transparent layers for illustrative purposes. A close up view 502 shows a detailed view of the middle portion of the resistor 500 showing the resistive element 520, the heat dissipation elements 510, and the dielectric material 540 covering external portions of the conductive elements 510 and the resistive element 520.

Figure 5D:
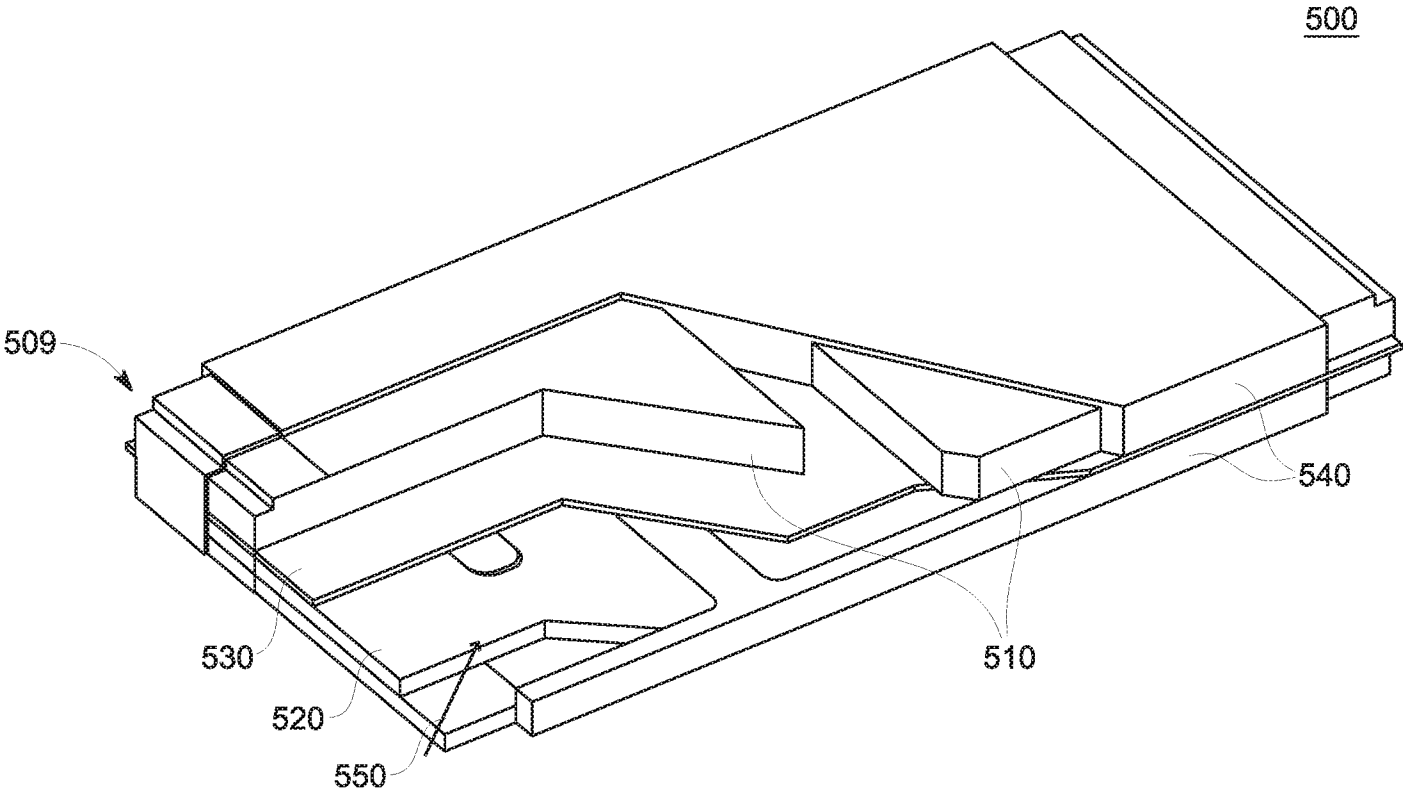
FIG. 5D shows an isometric view of the resistor of FIG. 5A with cutaway views for illustration purposes to show inner components or layers.

FIG. 5D shows an isometric view of the resistor 500 with cut away views for illustrative purposes. An adhesive material 530 (similar to adhesive material 230 or 330) formed on an upper surface of the resistive element 520 may thermally bond the heat dissipation elements 510 and the resistive element 520. Electrode layers 550 (similar to electrodes 250*a*, 250*b* or 350*a*, 350*b*) may be attached to a lower surface of the resistive element 520.

Figure 6A:
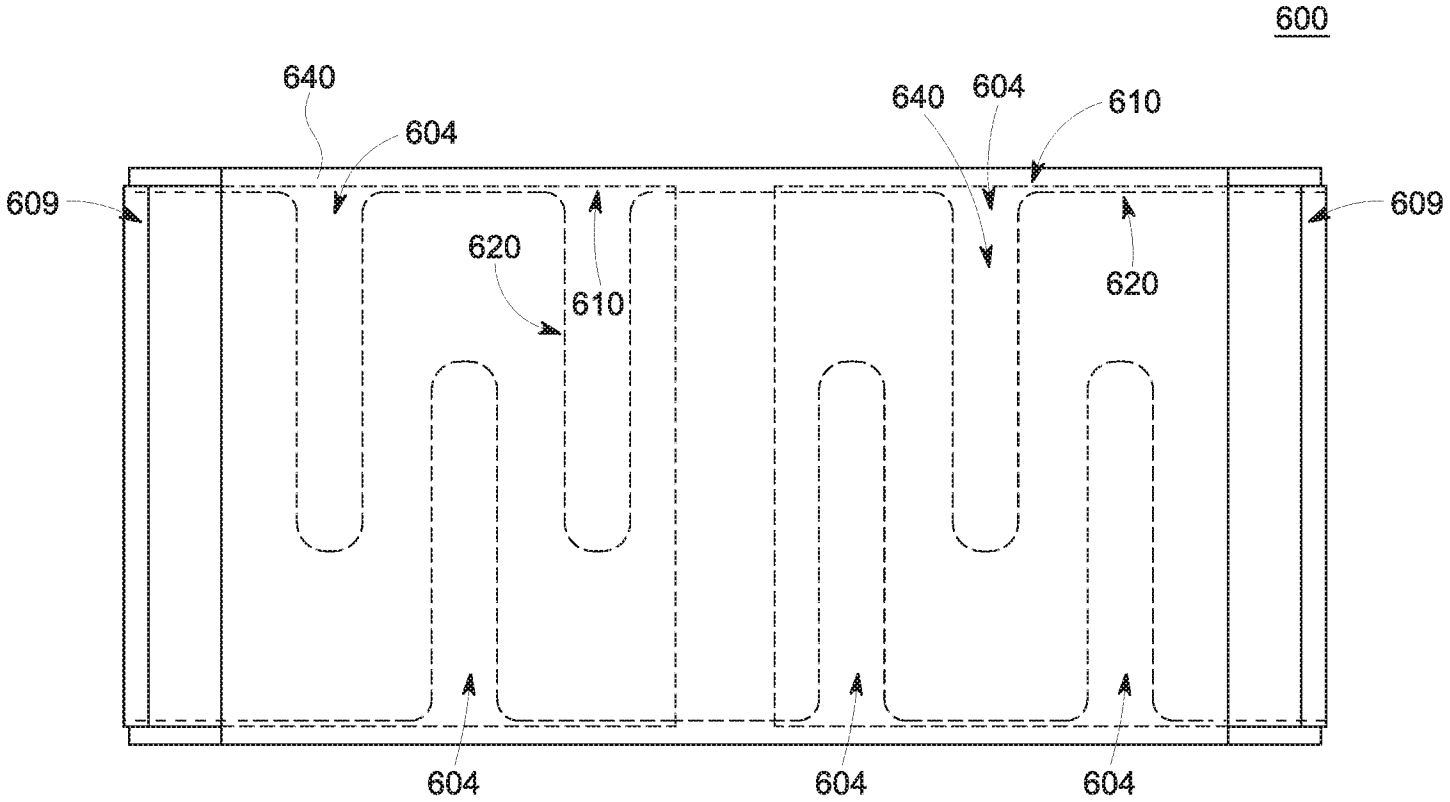
FIG. 6A shows a top view of a resistor.

FIG. 6A shows a top view of a resistor 600 with partially transparent layers for illustrative purposes. The resistor 600 may have swages 609 and may have a general arrangement as described above with respect to FIGS. 2A-2H or FIGS. 3A-3B. The resistor 600 may be similar to resistor 200 or resistor 300 and therefore may also utilize the descriptions of resistor 200 or resistor 300. FIG. 6A shows a transparent top view of the resistor 600, illustrating heat dissipation elements 610 (similar to the heat dissipation elements 210*a*, 210*b* or 310*a*, 310*b* above), a resistive element 620 (similar to the resistive element 220 or 320 above) and a dielectric material 640 (similar to the dielectric material 240*a*, 240*b* or 340*a*, 340*b* above).

The resistive element 620 may be calibrated, for example, by thinning to a desired thickness or by manipulating the current path by cutting through the resistive element 620 in specific locations based, for example, on the target resistance value for the resistor 600. The patterning may be done by chemical and/or laser etching. The resistive element 620 may be etched such that three grooves 604 are formed under each of the heat dissipation elements 610. The dielectric material 640 may fill the grooves 604. As can be seen in FIG.

6A, the heat dissipation elements 610 may have a width that is greater than the width of the resistive element 620 by approximately 2-4%.

Figure 6B:
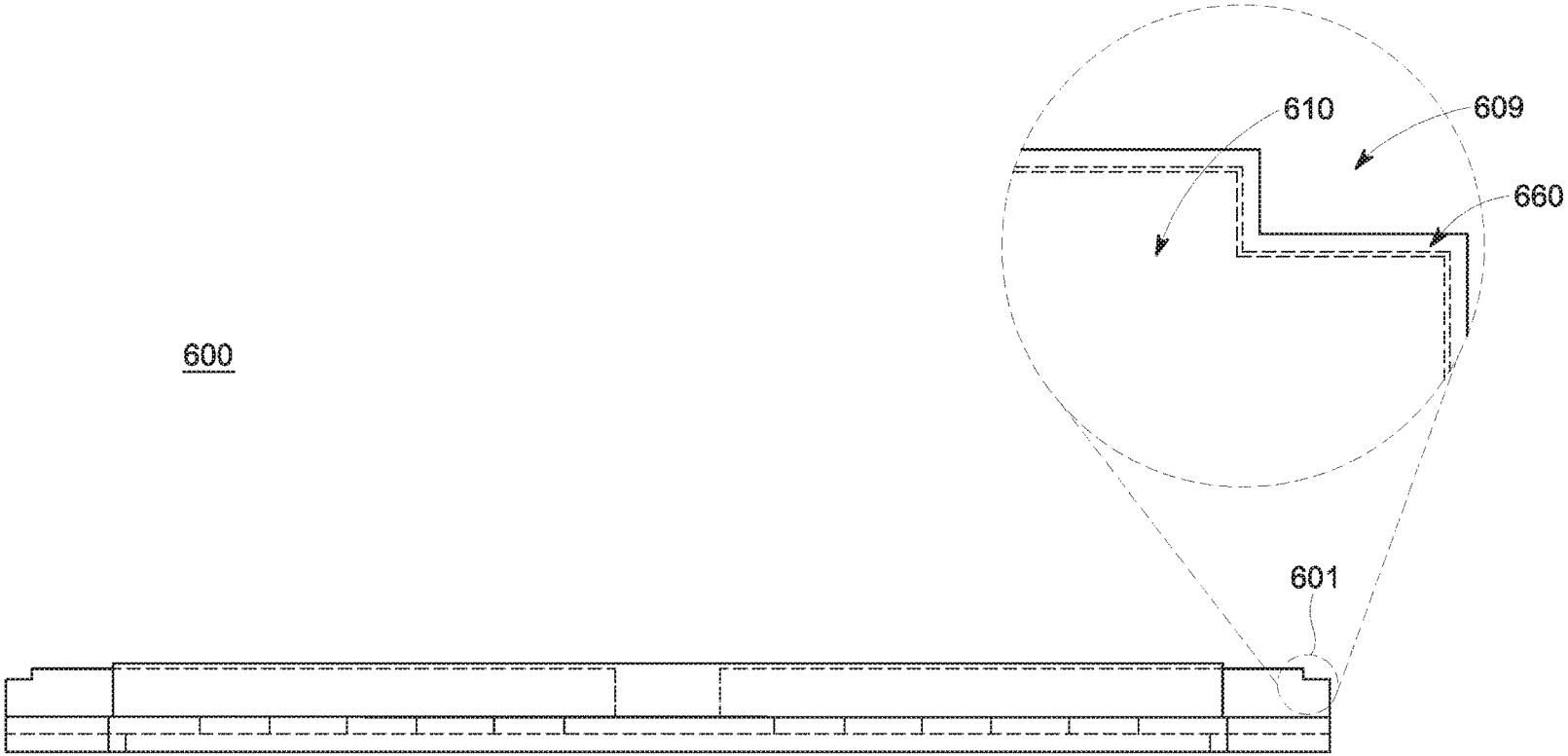
FIG. 6B shows a side view of the resistor of FIG. 6A along with a magnified view of a portion of the resistor.

FIG. 6B shows a side view of the resistor 600 with partially transparent layers for illustrative purposes. A close up view 601 of an upper corner of the resistor 600 is shown where heat dissipation elements 610 may be seen covered by a solderable element 660. A swage 609 may be located at the upper and outer corner of the heat dissipation elements 610 and corresponding solderable element 660.

Figure 6C:
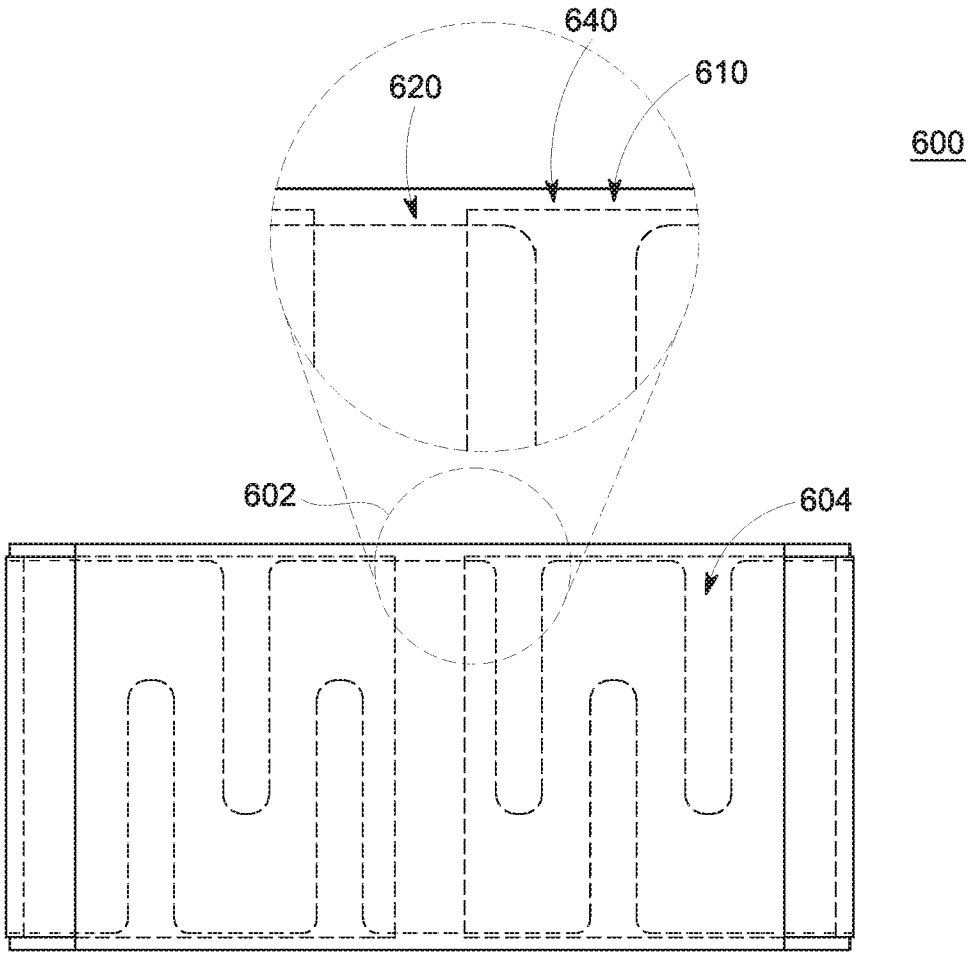
FIG. 6C shows a bottom view of the resistor of FIG. 6A along with a magnified view of a portion of the resistor.

FIG. 6C shows a bottom view of the resistor 600 with partially transparent layers for illustrative purposes. A close up view 602 shows a detailed view of the middle portion of the resistor 600 showing the resistive element 620, the heat dissipation elements 610, and the dielectric material 640 covering external portions of the conductive elements 610 and the resistive element 620.

Figure 6D:
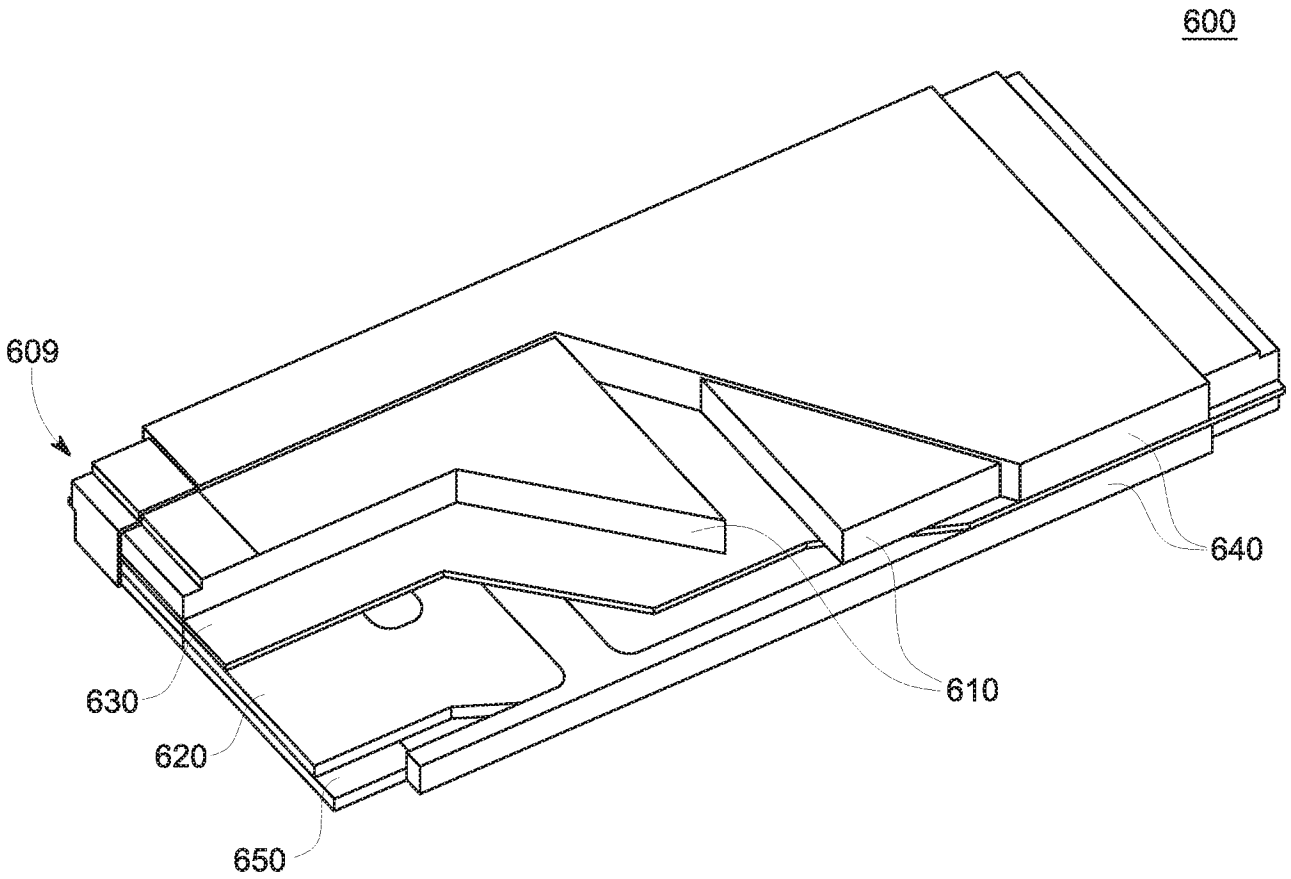
FIG. 6D shows an isometric view of the resistor of FIG. 6A with cutaway views for illustration purposes to show inner components or layers.

FIG. 6D shows an isometric view of the resistor 600 with cut away views for illustrative purposes. An adhesive material 630 (similar to adhesive material 230 or 330) formed on an upper surface of the resistive element 620 may thermally bond the heat dissipation elements 610 and the resistive element 620. Electrode layers 650 (similar to electrodes 250*a*, 250*b* or 350*a*, 350*b*) may be attached to a lower surface of the resistive element 620.

Figure 7:
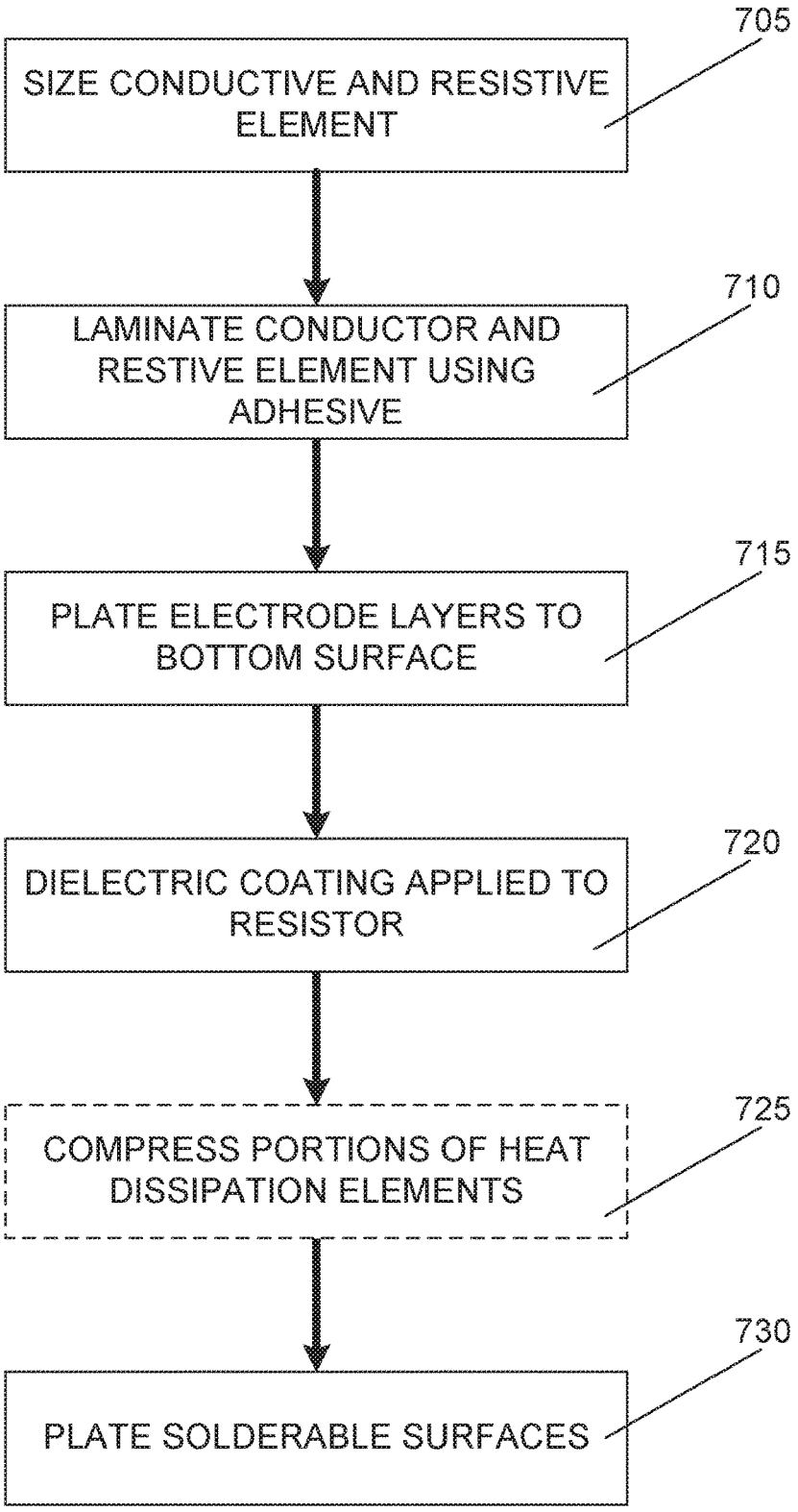
FIG. 7 shows a flow chart of an example process of manufacture.

FIG. 7 is a flow diagram of an illustrative method of manufacturing any of the resistors discussed herein. For example, resistor 200 will be used to explain the example process as shown in FIG. 7. In an example method, a conductive layer or layers, which will form the heat dissipation elements, and a resistive element 220, may be cleaned and cut (705), for example, to a desired sheet size. The conductive layer or layers and the resistive element 220 may be laminated together using an adhesive material 230 (710). Electrode layers are plated to portions of the bottom surface of the resistive element 220 (715) using plating techniques as are known in the art. The conductive layer may be masked and patterned to divide the conductor into separate heat dissipation elements. In an embodiment, the resistive element may be patterned, for example using chemical etching, and/or thinned, for example using a laser, to achieve a target resistance value. A dielectric material may be deposited, coated, or applied (720) on the top and bottom of the resistor 200 to electrically isolate the plurality of conductive layers forming heat dissipation elements from each other. In an optional step, described above with reference to FIGS. 2A-2H and 3A-3B, portions of the heat dissipation elements may be compressed (725) to form swages. The force of the compression may cause the adhesive layer to compress and/or the adhesive layer and bottom portions of the heat dissipation elements to bend down towards the resistive element at the edges.

The resistive element with one or more conductive layers (heat dissipation elements) may be plated (730) with solderable layers or terminals to electrically couple the resistive element to the plurality of conductive layers (heat dissipation elements).

In any of the embodiments discussed herein, the adhesive material may be sheared during singulation, eliminating the need to remove certain adhesive materials, such as Kapton, in a secondary lasing operation to expose the resistive element before plating.

Although the features and elements of the present invention are described in the example embodiments in particular combinations, each feature may be used alone without the other features and elements of the example embodiments or in various combinations with or without other features and elements of the present invention.

What is claimed is:

1. A resistor comprising:

a resistive element having an upper surface, a bottom surface, a first side, and an opposite second side; and a first heat dissipation element adjacent the first side of the resistive element and a second heat dissipation element adjacent the second side of the resistive element, wherein a gap is provided between the first heat dissipation element and the second heat dissipation element, wherein each heat dissipation element has an inner portion having a first height, and an outer portion, at least a portion of the outer portion having a second height less than the first height of the inner portion;

an adhesive material bonding and thermally coupling both the outer portions and the inner portions of the first heat dissipation element and the second heat dissipation element to the upper surface of the resistive element;

a first electrode layer positioned along the bottom surface of the resistive element, adjacent the first side of the resistive element;

a second electrode layer positioned along the bottom surface of the resistive element, adjacent the second side of the resistive element;

a dielectric material covering upper surfaces of the first heat dissipation element and the second heat dissipation element and filling the gap between the first heat dissipation element and the second heat dissipation element; and, a dielectric material deposited on the bottom surface of at least the resistive element and portions of bottom surfaces of the first and second electrode layers.

2. The resistor of claim 1, further comprising:

a first solderable layer covering a first side of the resistor, the first solderable layer in contact with the first heat dissipation element, the resistive element, and the first electrode layer; and, a second solderable layer covering a second side of the resistor, the second solderable layer in contact with the second heat dissipation element, the resistive element, and the second electrode layer.

3. The resistor of claim 2, wherein the first solderable layer covers at least a portion of the upper surface of the first heat dissipation element, and at least a portion of a bottom surface of the first electrode layer.

4. The resistor of claim 3, wherein the second solderable layer covers at least a portion of the upper surface of the second heat dissipation element, and at least a portion of a bottom surface of the second electrode layer.

5. The resistor of claim 1, wherein the adhesive is positioned only between the first and second heat dissipation elements and the resistive element.

6. The resistor of claim 1, wherein at least portions of the first heat dissipation element and the second heat dissipation element each have a swage at an upper and an outer corners of each of the heat dissipation elements.

7. The resistor of claim 6, wherein the swages form a step in at least portions of each of the heat dissipation elements.

8. The resistor of claim 1, wherein the first heat dissipation element and the second heat dissipation element each have portions that are stepped, angled or rounded.

9. The resistor of claim 1, wherein the resistive element comprises copper-nickel-manganese (CuNiMn), copper-manganese-tin (CuMnSn), copper-nickel (CuNi), nickel-chromium-aluminum (NiCrAl), or nickel-chromium (NiCr).

10. The resistor of claim 1, wherein the resistive element has a thickness of about 0.001" to about 0.015".

11. A method of manufacturing a resistor, the method comprising:

laminating a conductor to a resistive element using an adhesive;

masking and patterning the conductor to divide the conductor into a plurality of heat dissipation elements;

forming each heat dissipation element into an inner portion having a first height, and an outer portion, at least a portion of the outer portion having a second height less than the first height;

plating electrode layers on a bottom surface of the resistive element;

depositing a dielectric material on the bottom surface of the resistive element between and at least partially covering the electrode layers; and, depositing a dielectric material on at least portions of the plurality of heat dissipation elements to electrically isolate the plurality of heat dissipation elements from each other.

12. The method of claim 11, further comprising the steps of:

plating a first solderable layer to a first side of the resistor, the first solderable layer in contact with a heat dissipation element, the resistive element, and an electrode layer; and, plating a second solderable layer to a second side of the resistor, the second solderable layer in contact with a heat dissipation element, the resistive element, and an electrode layer.

13. The method of claim 12, wherein the first solderable layer covers at least a portion of the upper surface of a heat dissipation element, and at least a portion of a bottom surface of an electrode layer.

14. The method of claim 13, wherein the second solderable layer covers at least a portion of the upper surface of a heat dissipation element, and at least a portion of a bottom surface of an electrode layer.

15. The method of claim 11, wherein the adhesive is positioned only between the first and second heat dissipation elements and the resistive element.

16. The method of claim 11, wherein at least portions of the heat dissipation elements each have a swage at upper and outer corners of the heat dissipation elements.

17. The method of claim 16, wherein the swages form a step in at least portions of each of the heat dissipation elements.

18. The method of claim 11, wherein the heat dissipation elements each have portions that are stepped, angled or rounded.

19. The method of claim 11, wherein the resistive element has a thickness of about 0.001" to about 0.015".

20. A resistor comprising:

a resistive element;

first and second heat dissipation elements that are electrically insulated from one another by a dielectric material and are coupled to a top surface of the resistive element via an adhesive, each heat dissipation having a swage in at least portions of upper and outer corners of the heat dissipation elements, the swage providing for a first portion of each heat dissipation element having a first height, and a second portion of each heat dissipation element having a second height, the second height being less than the first height, the adhesive having portions positioned between the first portion and second portion of each heat dissipation element and the top surface of the resistor and coupling the first portion and second portion of each heat dissipation element to the top surface of the resistor;

a first electrode layer disposed on a bottom surface of the resistive element;

a second electrode layer disposed on a bottom surface of the resistive element; and, first and second solderable layers extending respectively along at least a portion of a bottom of the resistor including the first electrode layer and the second electrode layer, along at least a portion of a first outer side and at least a portion of a second outer side of the resistor, and along at least a portion of a top surface of the resistor;

wherein the first and second portions of each heat dissipation elements are thermally coupled to the resistive element via the adhesive material and solderable layers.

* * * * *